United States Patent [19]

Van de Sande et al.

[11] Patent Number: 4,663,273

[45] Date of Patent: May 5, 1987

[54] NON-DIFFUSING COMPOUNDS CAPABLE OF RELEASING A DIFFUSIBLE DYE OR DYE PRECURSOR COMPOUND WITH MULTIPLE DYE UNITS

[75] Inventors: Christian C. Van de Sande, Belsele; Armand M. Van den Bergh, Berchem; André Verhecken, Mortsel, all of Belgium

[73] Assignee: Agfa-Gevaert, N.V., Mortsel, Belgium

[21] Appl. No.: 874,685

[22] Filed: Jun. 16, 1986

Related U.S. Application Data

[63] Continuation-in-part of Ser. No. 689,133, Jan. 7, 1985, abandoned.

[30] Foreign Application Priority Data

Jan. 12, 1984 [EP] European Pat. Off. ..... 84200042.4

[51] Int. Cl.[4] ..... G03C 1/40; G03C 5/54; G03C 7/26

[52] U.S. Cl. ..... 430/563; 430/223; 430/559; 430/561

[58] Field of Search ..... 430/223, 559, 563, 561

[56] References Cited

U.S. PATENT DOCUMENTS

| | | | |
|---|---|---|---|
| 3,443,940 | 5/1969 | Bloom et al. | 430/223 |
| 3,628,952 | 12/1971 | Puschel et al. | 430/223 |
| 3,787,215 | 1/1974 | Piller | 430/563 |
| 4,139,379 | 2/1979 | Chasman et al. | 430/223 |
| 4,232,107 | 11/1980 | Sanssens | 430/223 |
| 4,358,527 | 11/1982 | Bailey et al. | 430/223 |
| 4,407,931 | 10/1983 | Evans | 430/223 |
| 4,468,452 | 8/1984 | Nakamura et al. | 430/223 |

*Primary Examiner*—Richard L. Schilling
*Attorney, Agent, or Firm*—A. W. Breiner

EXEMPLARY CLAIM

1. A photographic silver halide emulsion material which contains in operative contact with at least one alkali-permeable silver halide hydrophilic colloid emulsion layer a ballasted non-diffusing compound capable of releasing a diffusible dye or dye precursor corresponding to the following general formula:

CAR—L—D wherein:

CAR represents a carrier moiety,

L represents a chemical group cleavable or releasable from the carrier moiety by a redox-reaction in alkaline aqueous medium, and D represents a dye or dye precursor part containing:

(i) several dye units or dye precursor units that are linked chemically to each other by:

a non-metal atom bearing only single bonds, a polyvalent atom group wherein one atom links the dye units together by single bonds only, or a polyvalent atom group forming between the dye units a chain of atoms wherein at least one atom of the interlinking atoms of the backbone part of said chain has two consecutive single bonds in said backbone part, and (ii) incorporating one or more groups that improve the diffusibility of the released dye part or dye precursor part in a hydrophilic colloid medium when permeated by an aqueous alkaline liquid.

12 Claims, No Drawings

NON-DIFFUSING COMPOUNDS CAPABLE OF RELEASING A DIFFUSIBLE DYE OR DYE PRECURSOR COMPOUND WITH MULTIPLE DYE UNITS

This is a continuation-in-part of application Ser. No. 06/689,133, filed 1-7-85, now abandoned.

The present invention relates to photographic silver halide emulsion materials containing ballasted non-diffusing compounds capable of releasing a diffusible dye or dye precursor compound.

Important non-conventional multicolour reproduction systems are based on dye diffusion transfer processing. These systems are of particular value for reasons of simplicity of processing and rapidity of access to the colour image.

Dye diffusion transfer imaging can be carried out in a number of ways but each system is based on the same principle, namely the alteration of the solubility of dyes controlled by the development of the photographic silver image.

In commonly known dye diffusion transfer processes the dye-image-producing compounds are (A) initially mobile in alkaline aqueous media and become immobilized during processing, or (B) they are initially immobile and are mobilized during processing.

A survey of such processes is given by Christian C. Van de Sande in Angew.Chem.Int.Ed.Engl. 22 (1983) 191–209.

Known compounds for use in a dye diffusion transfer process include e.g. triphenylmethane, xanthene, azo, azomethine, anthraquinone, alizarine, merocyanine, quinoline or cyanine dye structures. Of particularly frequent use is a mono-azo-dye group (ref. e.g. U.S. Pat. No. 3,725,062).

Redox-controlled dye-releasing compounds are introduced in commercial systems and are known from various sources.

Oxidizable dye-releasing compounds that after oxidation release a dye moiety by hydrolysis are known, e.g., from DE-A No. 2,242,762, DE-A No. 2,406,664, DE-A No. 2,505,246, DE-A No. 2,613,005, DE-A No. 2,645,656 (DE-A stands for German Auslegeschrift) and Research Disclosure publications Nos. 15,157 (November 1976), 16,654 (April 1977) and 17,736 (January 1979).

In these references dye-releasing compounds are described in which the dye moiety is linked most frequently to an oxidizable carrier moiety through a sulphonamido group. The dye released from such compounds contains a sulphamoyl group.

Oxidizable dye-releasing compounds which in oxidized form release a dye moiety by intramolecular displacement reaction are described, e.g., in U.S. Pat. No. 3,443,940. The dye released from these compounds contains a sulphinate group.

It is particularly interesting in dye diffusion transfer to operate with dye-releasing compounds the dye release from which is inversely proportional to the development of a negative-working silver halide emulsion layer and whereby positive dye images can be formed in a receptor material.

Oxidizable dye-releasing compounds that in oxidized form are stable but in reduced state set free a dye moiety by an elimination reaction are described in DE-A No. 2,823,159 and DE-A No. 2,854,946. Compounds of that type when used in reduced form in an unexposed silver halide emulsion material are called IHO-compounds wherein IHO is the acronym for "inhibited hydrolysis by oxidation". When used in the oxidized form these compounds are called IHR-compound, wherein IHR is the acronym for "increased hydrolysis by reduction".

Reducible quinonoid IHR-compounds which after reduction can undergo a dye release with an intermolecular nucleophilic displacement reaction are described in DE-A No. 2,809,716 wherein these compounds are called BEND-compounds, BEND standing for "Ballasted Electron-accepting Nucleophilic Displacement".

Reducible IHR-compounds which after reduction can undergo a dye release with an elimination reaction are described in the published EP-A No. 0,004,399 and in the U.S. Pat. No. 4,371,604.

Other classes of compounds that may release a dye after reduction are described in DE-A No. 3,008,588 and DE-A No. 3,014,669.

Particularly useful are redox-controlled dye-releasing compounds according to the general formula:

BAL—REDOX—DYE wherein:

BAL represents a moiety with ballast residue for immobilizing the dye-releasing compound in a hydrophilic colloid layer, REDOX represents a redox-active group, i.e. a group that under the circumstances of alkaline silver halide development is oxidizable or reducible and depending on the oxidized or reduced state yields a dye release by an elimination reaction, nucleophilic displacement reaction, hydrolysis or cleavage reaction, DYE represents a diffusible dye moiety or a precursor thereof.

Since the redox-controlled reaction and the concentration wherein a dye is split off is mainly controlled by the coverage of developable silver halide, there are certain limitations as to the final absorption of coloured light by the dye image. While the degree of absorption of coloured light may be sufficient for a diffusion transfer dye image viewed on a reflective base, e.g. paper base, it may not be satisfactory when the same dye image is inspected with transmitted light passing only once through the dyed layer coated on a clear resin film base of a transparency.

In U.S. Pat. No. 3,725,062, cleavage dye diffusion transfer compounds are described, wherein more than one (two or four) dye-providing part is present on a same carrier molecule part [see compounds (2), (3), (9) and (10) of said U.S. Pat. No.].

The cleaving mechanism of the diffusible dye-releasing compounds of said U.S. Pat. No. allows a dual and even quadruple release of dye under alkaline conditions with a same amount of developable silver halide. The dye diffusion process of said last mentioned U.S. Pat. No. utilizes hydroquinones which provide diffusible dyes upon oxidation in alkaline conditions, which means that direct-positive-working silver halide emulsion layers of lower inherent sensitivity than negative-working silver halide emulsions have to be used when positive dye transfer images are to be formed.

The dual and even quadruple substitution of the hydroquinone nucleus with dye-releasing substituents causes particular difficulties in synthesis and is not universally applicable to all known "carrier" moieties wherefrom the dye part has to be released. For example, the application of two —$CH_2$—$SO_2$—dye substituents in para-position on a quinone nucleus of the type disclosed in EP No. 000 4399 does not allow twofold dye release by a redox-reaction under alkaline conditions.

From U.S. Pat. Nos. 4,468,452, 4,407,931 and 4,358,527 it is known to apply photographic silver halide diffusion transfer materials containing redox dye releasers that release complexed dye moieties containing two dye units linked by a polyvalent complexing metal atom. In these compounds the dye units linked by said complexing atom do not retain their individual absorption spectrum which becomes lost by complexation and yields one single new absorption spectrum.

From U.S. Pat. Nos. 3,443,940 and 3,628,952 photographic silver halide diffusion transfer materials containing quinonoid redox dye releasers are known that contain a bisazo dye. Bisazo dyes form a single chromophoric system in which the individuality of each azo chromophore is lost by linking the chromophores through a conjugated linking group with alternating single and double bonds.

It is an object of the present invention to provide photographic silver halide emulsion materials containing new compounds for use in a photographic dye diffusion transfer process and which compounds have a plurality of dye units that each substantially retain their individual spectral absorption character and allow economy on silver coverage by higher yield of colour density for a given silver halide content.

A dye releasing compound containing several dye units that each have their own absorption spectrum which may be identical allows to economize on silver because for a same weight of exposed silver halide an amount of dye is split off that rerpresents the sum of extinction values of each dye unit, each dye unit substantially retaining its individual light absorption. As an alternative the use of said compounds compared with prior art compounds makes it possible to obtain a same colour density at a lower silver halide coverage, thus allowing the coating of thinner layers at higher coating and drying speed and having improved image sharpness.

In accordance with the present invention a photographic silver halide emulsion material contains in operative contact with at least one alkali-permeable silver halide hydrophilic colloid emulsion layer a ballasted non-diffusing compound capable of releasing a diffusible dye or dye precursor corresponding to the following general formula:

CAR—L—D wherein:

CAR represents a carrier moiety, e.g. as described hereinafter, preferably a carrier moiety comprising a quinonoid-nucleus, L represents a chemical group cleavable or releasable from the carrier moiety by a redox-reaction in alkaline aqueous medium, and D represents a dye or dye precursor part containing:

(i) several dye units or dye precursor units that are linked chemically to each other by:

a non-metal atom bearing only single bonds, e.g. —O— or —S—, or a polyvalent atom group wherein one atom links the dye units together by single bonds only, e.g. —$SO_2$—, —$CH_2$— or —NH—, or a polyvalent atom group forming between the dye units a chain of atoms wherein at least one atom of the interlinking atoms of the backbone part of said chain has two consecutive single bonds in said backbone part, and (ii) incorporating one or more groups that improve the diffusibility of the released dye part or dye precursor part in a hydrophilic colloid medium when permeated by an aqueous alkaline liquid, e.g. one or more members selected from the group consisting of hydroxyl, ether, thio-ether, carbonamido, sulphonamido, carbamoyl, sulphamoyl, onium, amino, sulphonyl, ureido, cyano, carboxylic acid, sulphinic acid, sulphonic acid, phosphonic acid and salts and ester groups derived from these acidic groups.

Representatives of these compounds comprise a group D corresponding to the following general formula:

$$-(A)_x[-B(-C)_y]_z$$

wherein:

A is $L^1$, $L^1D^1$ or $D^1$,

B is $L^2$, $L^2D^2$ or $D^2$,

C is $L^3$, $L^3D^3$ or $D^3$, x is 0 or 1, y is 0, 1, 2 or 3, and z is 1, 2 or 3, so that the above formula comprises at least 2 members, preferably from 2 to 5 members, selected from $D^1$, $D^2$ and $D^3$ and that when y and/or z are 2 or 3, both the several B-groups and the several C-groups have the same or different meaning, and wherein:

each of $L^1$, $L^2$ and $L^3$ (the same or different) represents a non-conjugating linking member being a collective expression for:

a non-metal atom bearing only single bonds, e.g. —O— or —S—, or a polyvalent atom group wherein one atom links the dye units together by single bonds only, e.g. —$SO_2$—, —$CH_2$— or —NH—, or a polyvalent atom group forming between the dye units a chain of atoms wherein at least one atom of the interlinking atoms of the backbone part of said chain has two consecutive single bonds in said backbone part, e.g. —$SO_2$NH—, —CONH—, bivalent non-conjugating hydrocarbon such as alkylene or trivalent non-conjugating groups examples of which are given hereinafter, preferably that linking member includes diffusion promoting substituents; and each of $D^1$, $D^2$ and $D^3$ (the same or different) represents a dye or dye precursor unit.

These dye units or their precursors can belong to or be derived from any dye class. Azo dyes are preferred. Dye precursors are either derivatives which by alkaline hydrolysis set free the actual dye, or compounds which generate the dye e.g. from a leuco dye form by oxidation.

Examples of polyvalent $L^1$, $L^2$ and $L^3$ non-conjugating linking groups are:

—CONH—$(CH_2)_2$—$NHSO_2$—

-continued
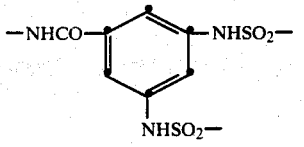
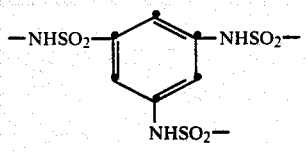
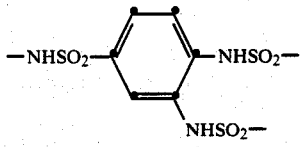
-continued
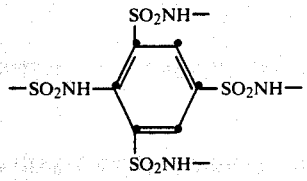
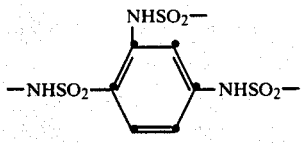
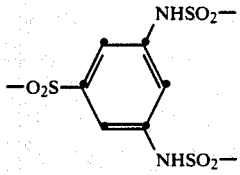
Particularly useful groups D contain at least two dye units having each an azo chromophore and correspond, e.g., to one of the structural formulae listed hereinafter in Table 1.
TABLE 1
(1)
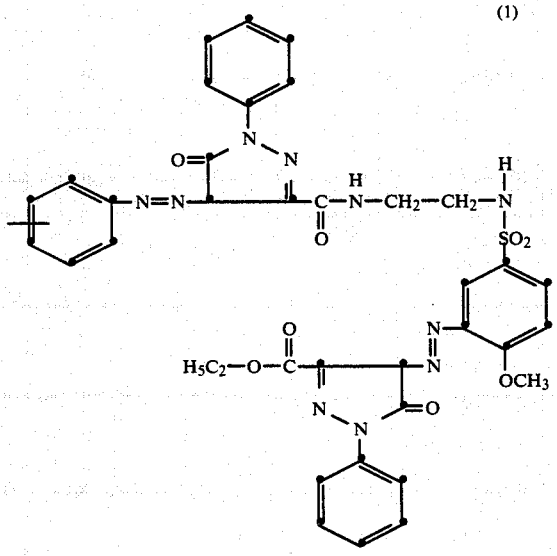
(2)
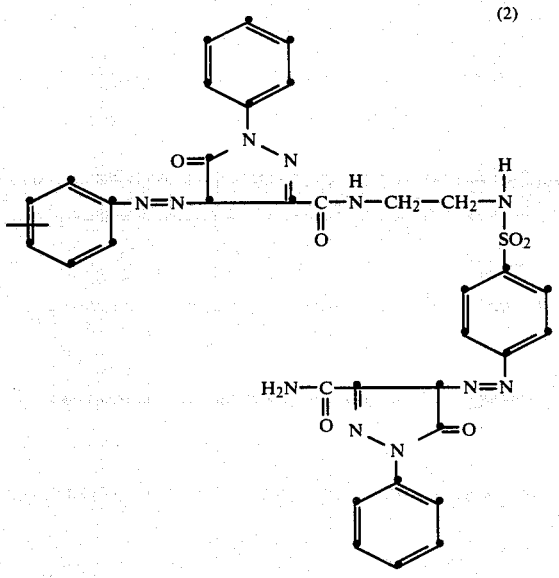
(3)
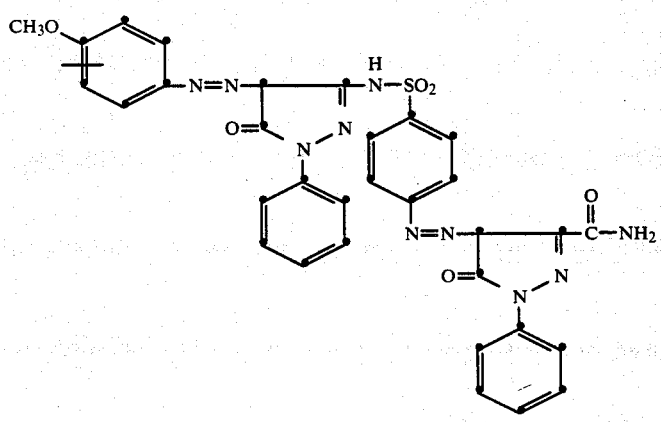

TABLE 1-continued
(4)
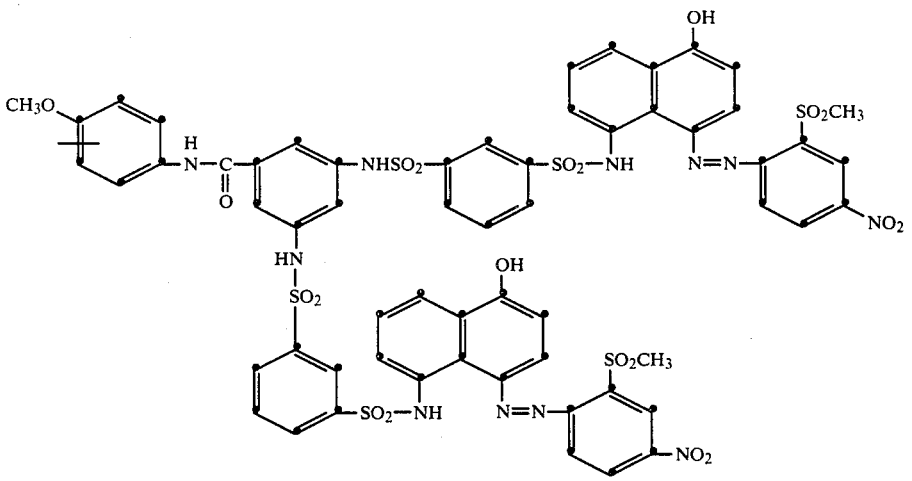
(5)
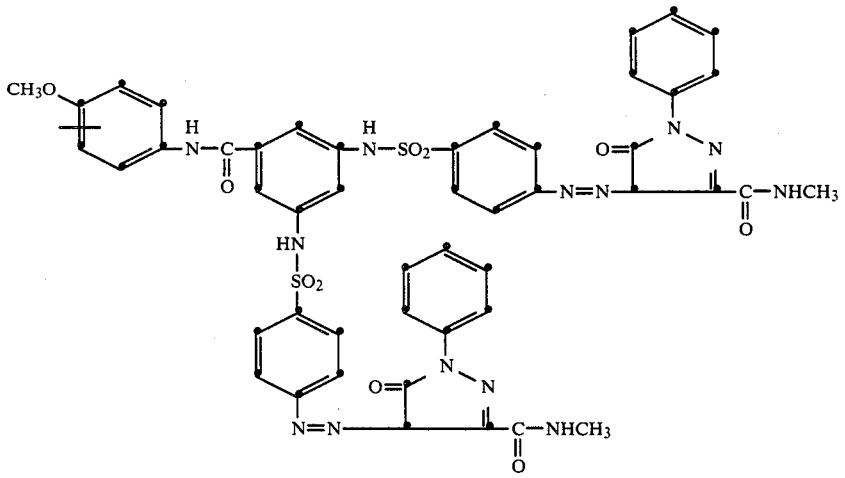
(6)
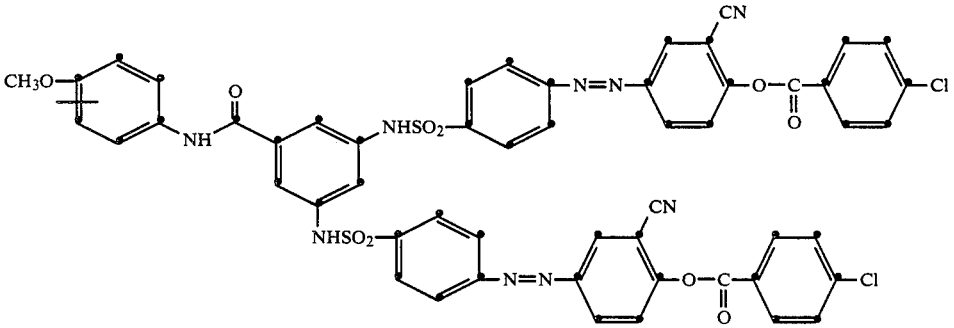

TABLE 1-continued
(7)
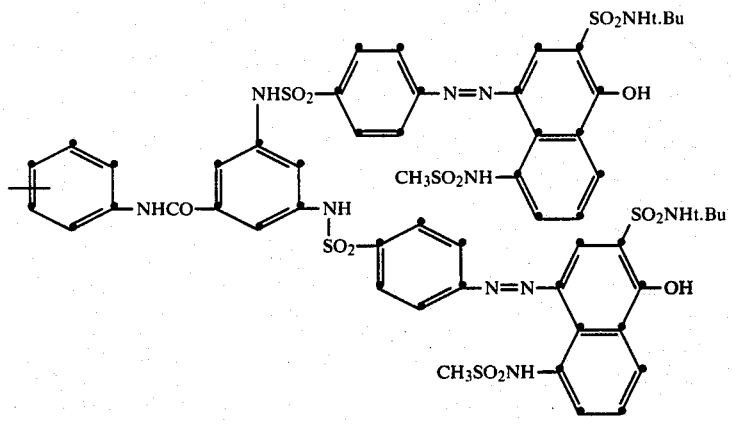
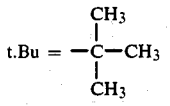
(8)
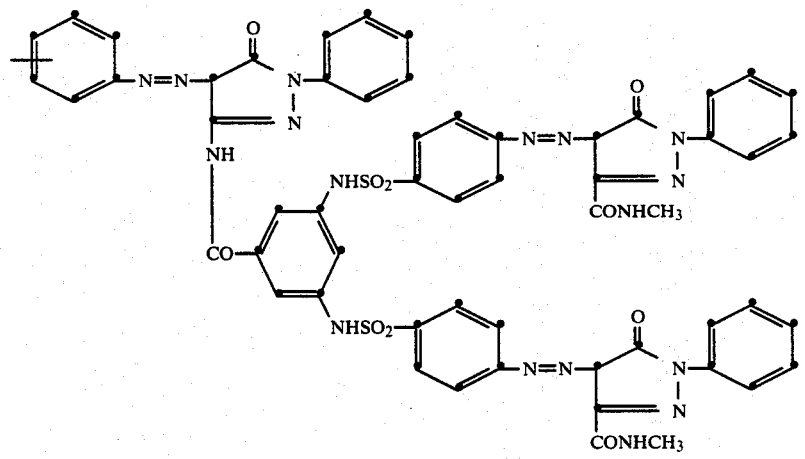
(9)
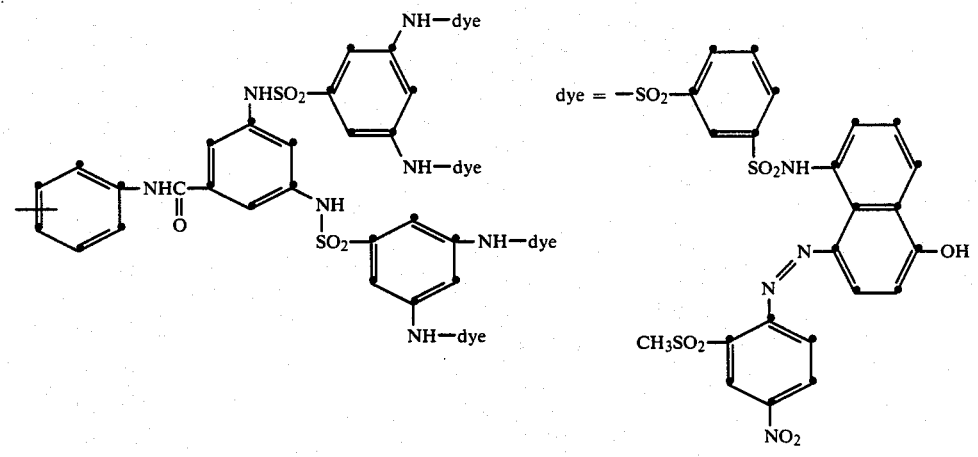

TABLE 1-continued
(10)
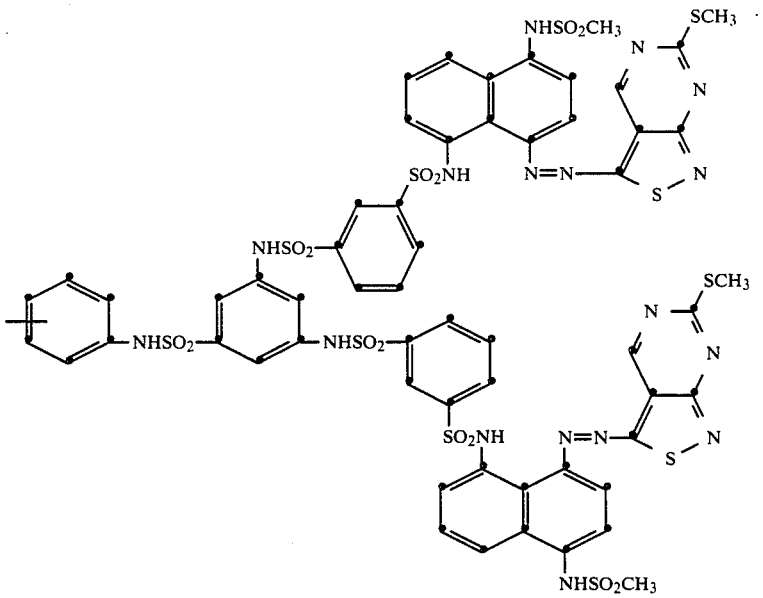
(11)
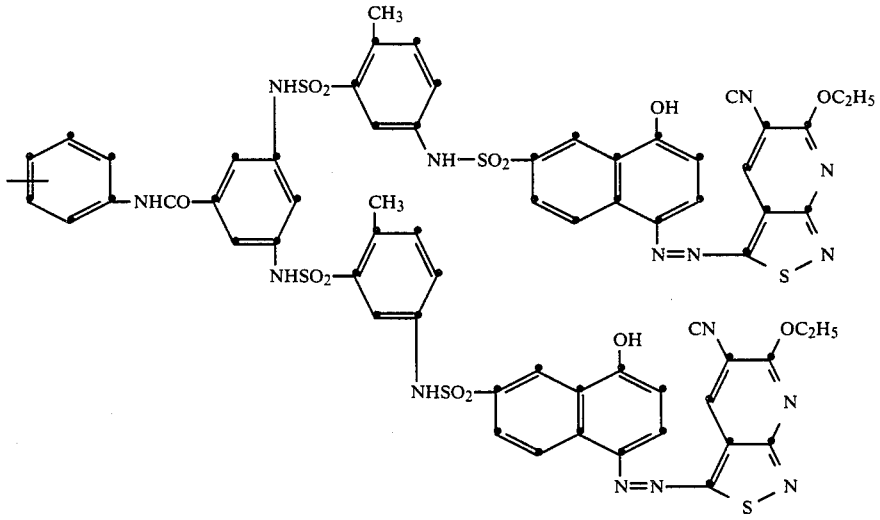
(12)
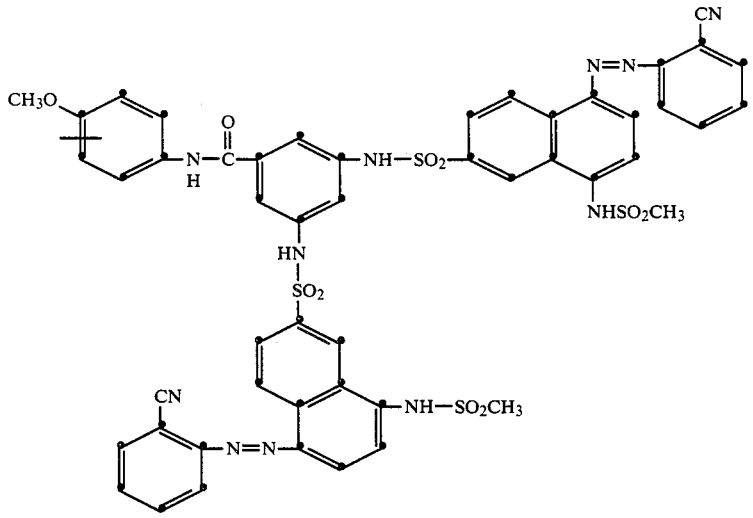

TABLE 1-continued (13)

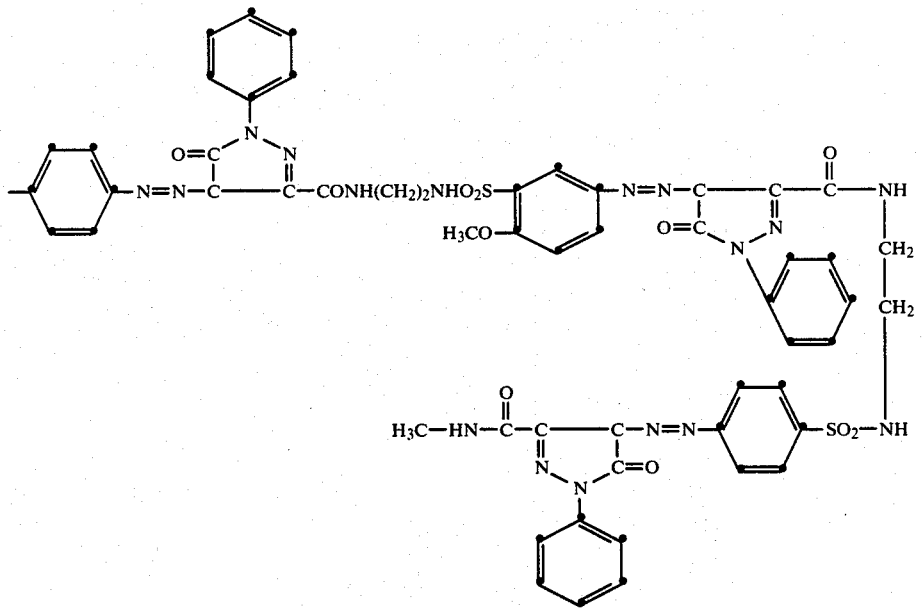

Examples of oxidizable carrier moieties (CAR—L—) wherefrom in oxidized form a dye moiety is split off are given hereinafter.

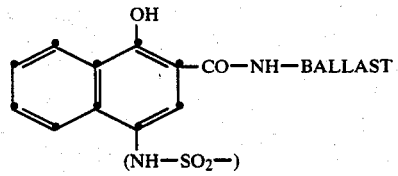

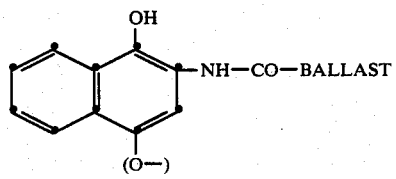

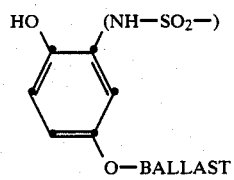

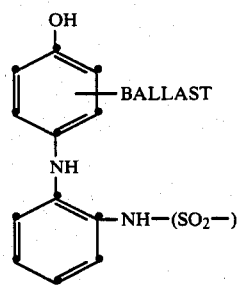

-continued

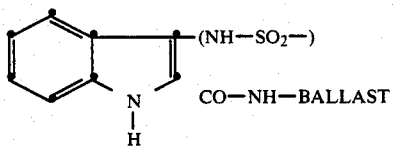

The groups within brackets are released together with the dye moiety (not represented), and remain as diffusion promoting groups with the dye moiety.

In the above mentioned dye-releasing compounds the dye release proceeds directly proportional to the rate of formation of the oxidation products of developing agent used in the development of silver halide. Said compounds are therefore negative working in that they undergo dye release in correspondence with the exposed portions of a negative working silver halide emulsion layer. For the production of positive pictures an image reversal is needed which may be based on the use of positive-working layers containing a direct-positive silver halide emulsion or on the silver salt complex diffusion transfer process by selecting a proper layer assemblage as described, e.g., in EP-A No. 0,003,376.

Examples of reducible carrier moieties (CAR—L—) wherefrom a dye moiety can be set free after reduction are the following:

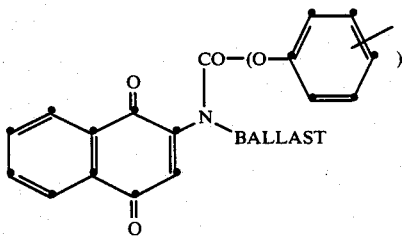

-continued

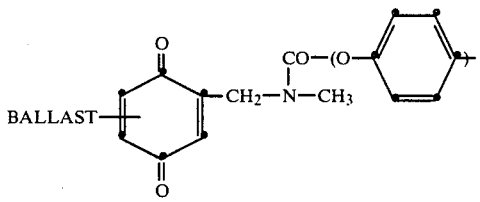

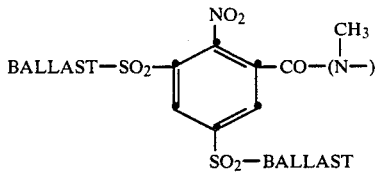

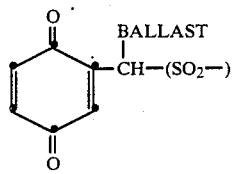

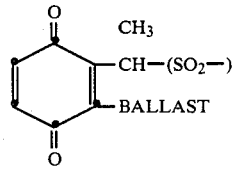

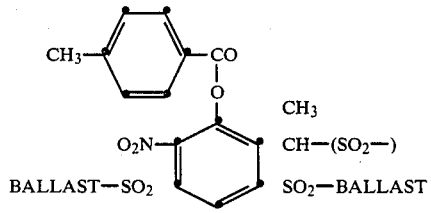

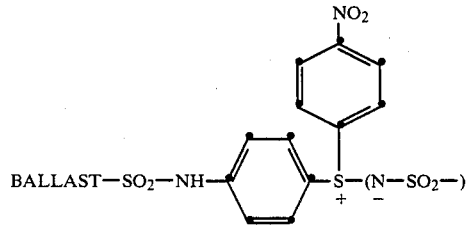

The groups within brackets are functional groups that are split off together with the dye moiety (not shown). These functional groups optionally together with said linking member, may be of importance to determine the diffusion-mobility and/or capability of the released dye to be mordanted. Useful linking members are, e.g., alkylene and arylene groups.

Ballast residues that confer diffusion resistance are residues which allow the compounds according to the invention to be incorporated in a non-diffusing form in the hydrophilic colloids normally used in photographic materials. Organic residues, which generally carry straight- or branched-chain aliphatic groups and also isocyclic or heterocyclic or aromatic groups mostly having from 8 to 20 carbon atoms are preferred for this purpose. These residues are attached to the remainder of the molecule either directly or indirectly, e.g. through one of the following groups: —NHCO—; —NHSO$_2$—; —NR—, in which R represents hydrogen or alkyl; —O—; —S—; or —SO$_2$—. The residue which confers diffusion resistance may in addition carry groups which confer solubility in water, e.g. sulpho groups or carboxyl groups, and these may also be present in anionic form. Since the diffusion properties depend on the molecular size of the compound as a whole, it is sufficient in some cases, e.g., if the entire molecule is large enough, to use one or more shorter-chain groups as groups conferring resistance to diffusion.

In a preferred embodiment for positive dye image production with negative working silver halide emulsions the above groups D form part of the already mentioned dye releasing quinonoid IHR-compounds wherefrom a diffusible dye moiety is released by reduction and hydrolysis.

The reaction operative in the release of a dye moiety from said qunonoid IHR-compounds proceeds in two stages (A) and (B) illustrated by the following equations:

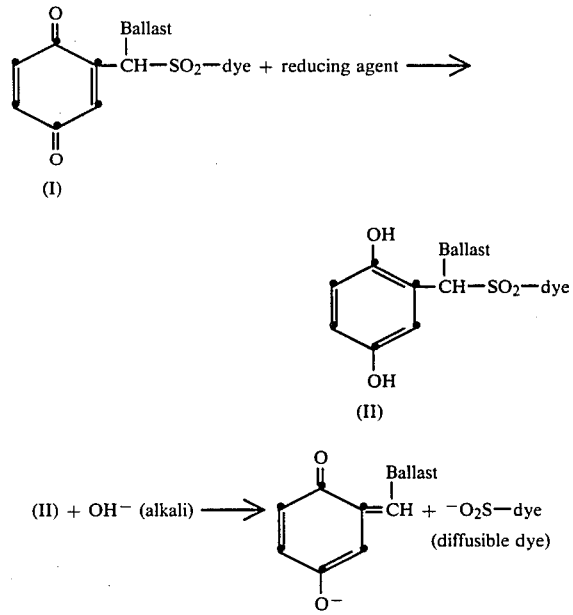

wherein: "Ballast" stands for a ballasting group making the compound non-diffusing in a hydrophilic colloid medium under wet alkaline conditions.

The terminology "diffusing" in this invention denotes materials having the property of diffusing effectively through the colloid layers of the photographic elements in alkaline liquid medium. "Mobile" has the same meaning. The term "non-diffusing" has the converse meaning.

The following preparations illustrate the synthesis of particularly useful IHR-compounds according to the present invention having a quinonoid-carrier part and a plurality of azo dye units.

A first example of a preparation of yellow IHR-quinonoid compounds is illustrated by the following reaction scheme followed in preparation 1.

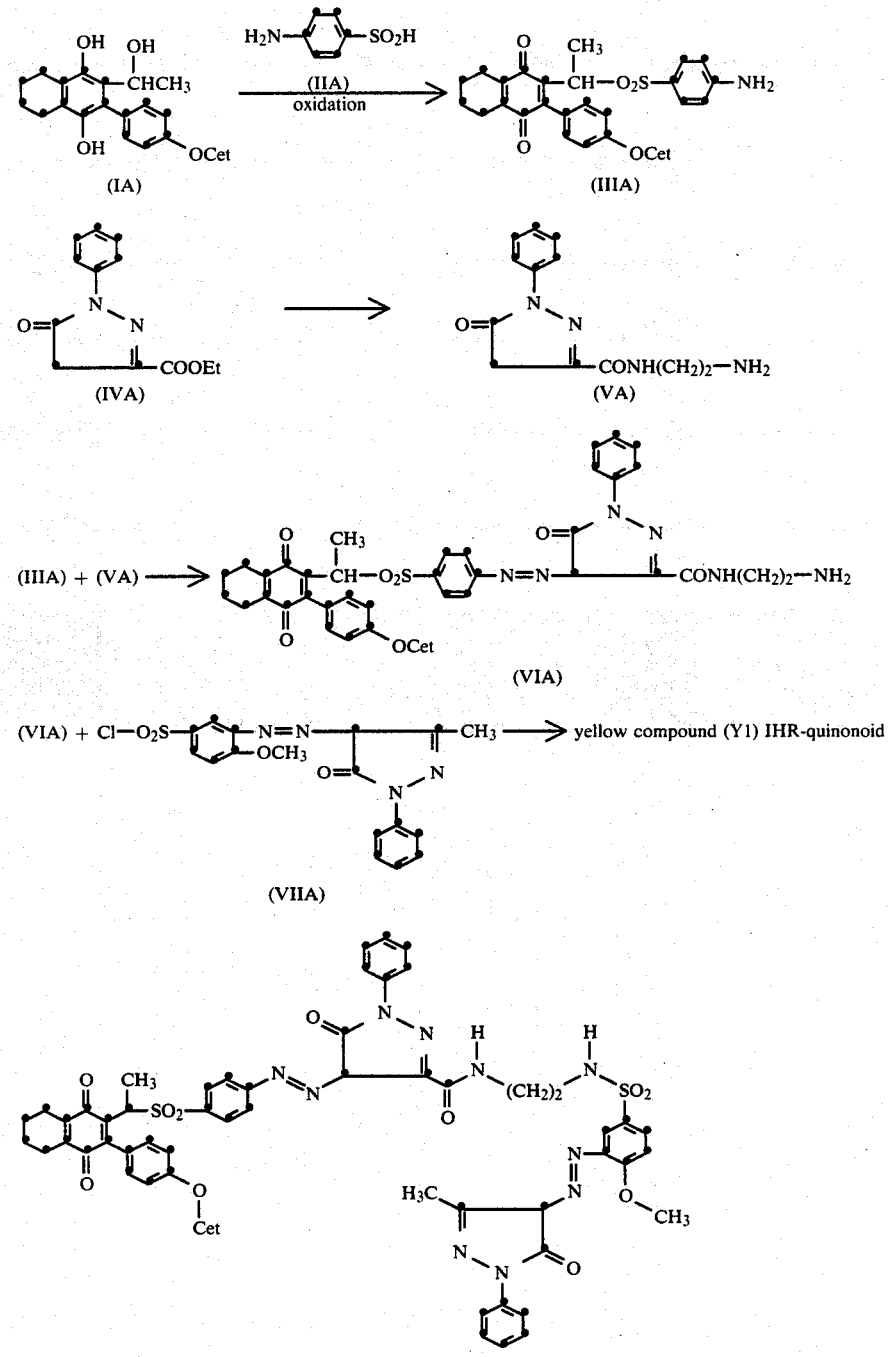

Cet = n-$C_{16}H_{33}$—
Et = $H_5C_2$—

Preparation 1

Synthesis of compound (IIIA)

524 g of compound (IA) prepared according to U.S. Pat. No. 4,477,554 entitled "Diffusion transfer material and process" filed on Oct. 20th 1983, and 204 g of p-aminobenzene sulphinic acid (IIA) were stirred in 3 l of acetic acid for 30 min. To the obtained mixture a solution of 120 ml of sulphuric acid in 300 ml of water was added and stirring was continued at 50° C. for 3 h. Thereupon 600 g of $FeCl_3.6H_2O$ was added and stirring was continued at 50° C. for 4 h. Then 2 l of water was added, the reaction product was allowed to settle and the aqueous acetic acid solution was decanted. The precipitate was stirred in a mixture of 2.4 l of methylene chloride, 400 ml of water and 200 ml of a 40% by weight aqueous iron(III) chloride solution and refluxed for 2 h. After cooling to room temperature the aqueous phase was separated, the organic phase washed with water, dried and evaporated to dryness. The sticky residue was stirred in 4 l of benzine, suction-filtered and washed again with benzine. Yield: 408 g. Melting point about 90° C. By thin-layerchromatography with a methylene chloride/ethyl acetate mixture (95/5) as an eluent only two minor contaminants were detected.

Synthesis of compound (VA)

92 g of compound (IVA) and 240 ml of 1,2-ethanediamine were stirred at 100° C. for 3 h. The excess of 1,2-ethanediamine was removed by evaporation and the residue treated with toluene. After evaporation of the toluene the residue was stirred in 500 ml of methanol. The precipitate was suction-filtered, washed with methanol and dried. Yield: 80 g. Melting point: >260° C. (decomposition). By thin-layer chromatography with a mixture of acetonitrile and water (90/10) only two minor contaminants were detected.

Synthesis of compound (VIA)

90 g of compound (IIIA) was stirred in a mixture of 1 l of acetone and 63 ml of hydrochloric acid at 5° C. Diazotation was carried out with 11.7 g of sodium nitrite dissolved in 27 ml of water. The reaction mixture was stirred at 5° C. for 1 h and the excess of nitrite was decomposed with urea.

The diazonium salt solution was added at 5° C. in small portions to a solution of 36 g of compound (VA) in a stirred mixture of 900 ml of methanol and 18 g of potassium hydroxide. Stirring was continued at 5° C. for 1 h whereupon the temperature was raised to 20° C. The formed precipitate was separated by suction-filtering, washed with methanol and dried. Yield: 125 g. Melting point: 192° C.

Synthesis of compound (VIIA)

1-phenyl-3-methyl-4-(2-methoxy-5-chlorosulphonyl-phenylazo)-pyrazolone-(5)

826 g of the sodium salt of 1-phenyl-3-methyl-4-(2-methoxy-5-sulphonic acid phenylazo)-pyrazolone-(5) prepared as described hereinafter was stirred in 6 l of toluene, whereupon a mixture of toluene and water was distilled off till the condensate became clear. Then fresh toluene was added so as to restore the original volume, whereupon the solution was allowed to cool to 70° C. Then 80 ml of dimethylformamide was added followed by 580 ml of thionyl chloride at 70° C. in 30 min. The mixture was stirred at 80° C. for another 30 min. The end of the reaction was established by thin-layer chromatography. The excess thionyl chloride was evaporated at 90° C. whereupon the reaction was finished under slightly reduced pressure. The reaction mixture was allowed to cool to 25° C. and the precipitate formed was filtered with suction and washed with 1 l of toluene. It was dried first at 30° C. in a ventilated oven and then in a vacuum oven.

Yield: 882 g.

By thin-layer chromatography with methylene chloride/methanol mixture (98/2) as an eluent only a faint spot of dye sulphonic acid was detected.

Synthesis of 1-phenyl-3-methyl-4-(2-methoxy-5-sulphonic acid-phenylazo)-pyrazolone-(5) sodium salt.

1015 g of 3-amino-4-methoxybenzenesulphonic acid was stirred in 5 l of ice-water and 1 l of strong hydrochloric acid. To this mixture a solution of 352 g of sodium nitrite in 2 l of water was dropwise added at 0°-5° C. A mixture of 10 l of water, 1272 g of sodium carbonate (an excess for counteracting the formation of foam) and 915 g of 1-phenyl-3-methylpyrazolone-(5) was stirred and cooled externally with ice. To this solution the above diazonium solution was gradually added at 0°-15° C. and the whole was stirred for ½ h. The precipitate formed was filtered with suction and washed with 5% aqueous sodium chloride solution. The precipitate was dried, first in a ventilated drying oven at 30° C. and then in a vacuum drying oven. Yield: 2225 g of product, which still contained some water as well as 7% of sodium chloride.

By thin-layer chromatography with a methylene chloride/methanol mixture (80/20) as an eluent no other contaminants were detected.

Synthesis of IHR-quinonoid compound (Y1):

6.6 g of compound (VIA) was dissolved in 50 ml of methylene chloride and 50 ml of pyridine (solvents are dry).

8.3 g of compound (VIIA) was added and the mixture was refluxed for 3 h. The precipitate was filtered off and discarded, the filtrate was washed first with aqueous diluted hydrochloric acid and then with water, dried on anhydrous sodium sulphate, and the solvent distilled off in a rotary evaporator. Residue: 7 g.

This was purified by preparative column chromatography, using a mixture of methylene chloride/ethyl acetate (80/20) as an eluent.

Yield: 4 g of pure product, which in thin-layer chromatography (eluent methylene chloride/ethyl acetate—90/10) showed only one spot.

The intermediate product (VIIA) may be replaced by other pyrazolone (5) compounds in the above preparation, e.g. by 1-phenyl-3-ethoxycarbonyl-4-(2-methoxy-5-chlorosulphonyl-phenylazo)pyrazolone-(5) or 1-phenyl-3-N-methylcarbamoyl-4-(4-chlorosulphonyl-phenylazo)pyrazolone-(5) to yield the IHR-quinonoid compounds Y2 and Y3 respectively.

Y2

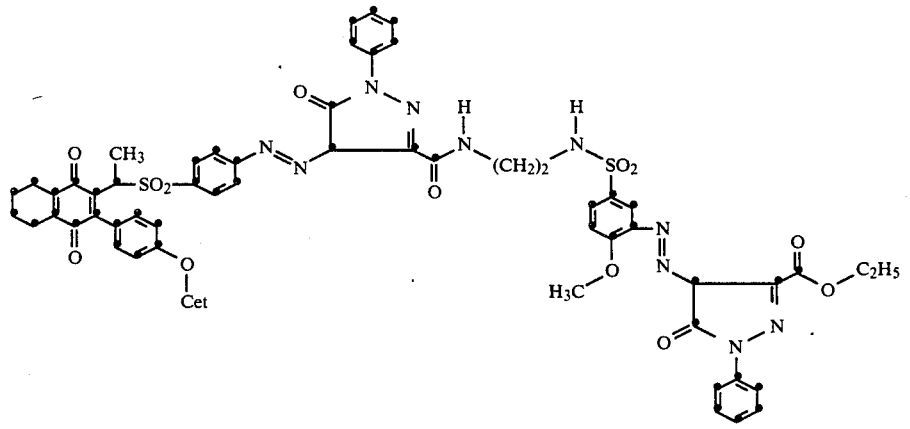

-continued
and
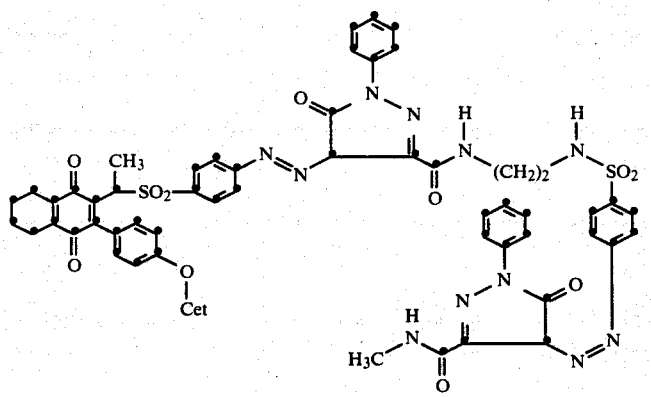
Y3
One more example of a preparation of a yellow IHR-quinonoid compound according to the invention is illustrated by the following reaction scheme followed in preparation 2.
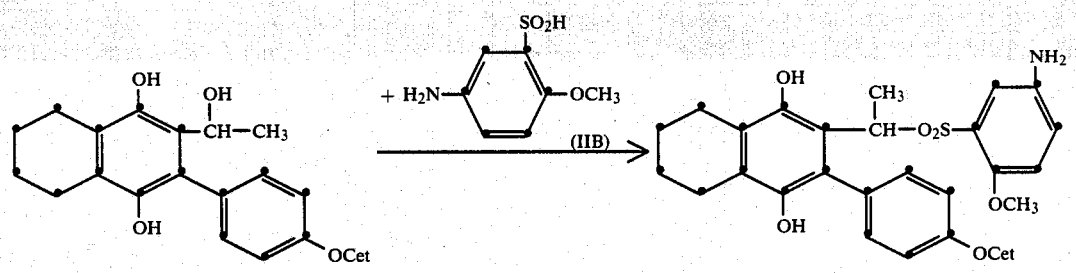
(IB) (IIIB)
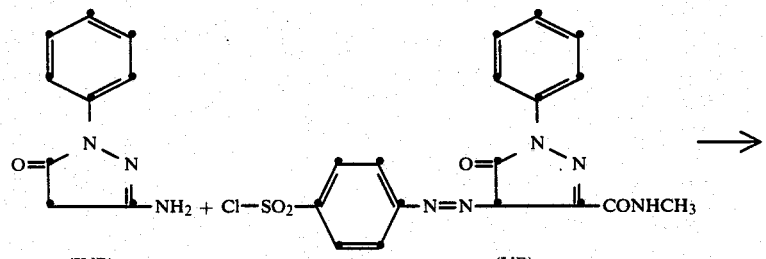
(IVB) (VB)
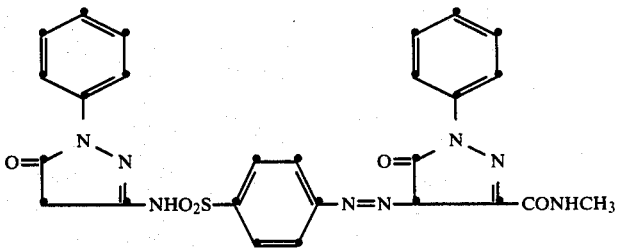
(VIB)
(IIIB) diazonium salt + (VIB) ⟶ yellow IHR—quinonoid compound (Y4)

-continued

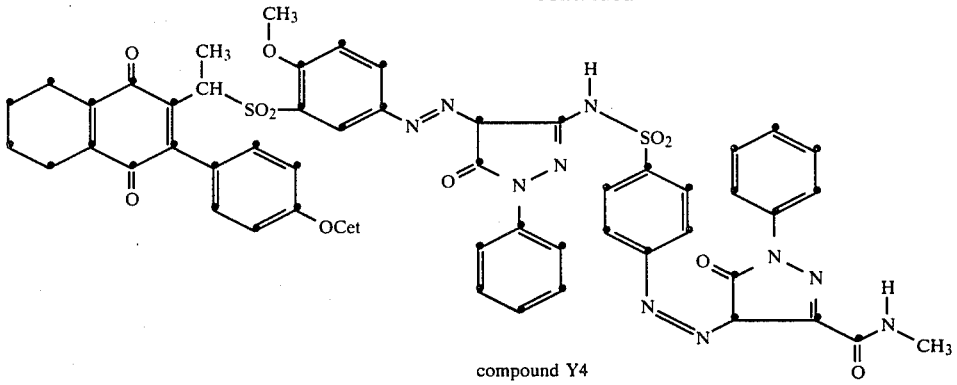

compound Y4

Preparation 2

Synthesis of 4-methoxy-acetanilide

To a suspension of 100 g of p-anisidine in 100 ml of acetic acid 100 ml of acetic anhydride was dropwise added with stirring whereby the reaction temperature rose to 50° C. Stirring was continued at 50° C. till complete dissolution of all ingredients. The reaction mixture was then put on ice for solidification overnight. The solid mass was suction-filtered, washed with water till neutral and dried. Yield: 118 g of 4-methoxy-acetanilide. Melting point: 129° C.

Synthesis of 4-methoxy-6-sulphonylchloride-acetanilide 236 ml of chlorosulphonic acid was heated to 40° C. and 118 g of 4-methoxy-acetanilide was added portionwise in the temperature range of 40°–50° C. The reaction mixture was cooled to 20° C. and poured on 1.4 kg of ice. The precipitate formed was suction-filtered washed till neutral by stirring in twice in 800 ml of water.

Synthesis of 2-methoxy-sulphinic acid (IIB)

186.5 g of anhydrous sodium sulphiate and 124 g of sodium hydrogen carbonate were dissolved at 50° C. in 1.4 l of water. At 50° C. the sulphochloride obtained in the preceding synthesis, while still moist was added to this solution and mixed with 430 ml of 10N aqueous sodium hydroxide solution. The reaction mixture was refluxed for 2 h and then cooled to 20° C. After acidification with 540 ml of concentrated hydrochloric acid the formed precipitate was suction-filtered, washed twice with water and twice with acetone and dried.

Yield: 60 g of sulphinic acid (IIB).

Synthesis of compound (IIIB)

52.4 g of compound (IB) identical to compound (IA) and 20.5 g of compound (IIB) were stirred at 60° C. for 3 h in a mixture of 600 ml of acetic acid, 60 ml of water and 6 ml of sulphuric acid. The formed precipitate was suction-filtered, washed with methanol and dried.

Yield: 61.2 g. Melting point: about 190° C. (decomposition).

Synthesis of compound (VIB)

4 g of 1-phenyl-3-amino-pyrazolone-(5) (IVB) and 10.5 g of compound (VB) prepared in analogy to the procedure described in U.S. Pat. No. 4,269,924 were introduced into a mixture of 50 ml of dichloroethane and 37 ml of dry pyridine and refluxed for 1 h. Thereupon another 5 g of compound (VB) was added and refluxed for still 1 h. The reaction mixture was poured into a mixture of 375 ml of water and 300 ml of ethanol, and acidified with hydrochloric acid. The extraction of compound (VIB) was effected with methylene chloride, the organic layer separated and the solvent removed by evaporation.

Yield: 21 g of crude compound (VIB). Purification proceeded by column chromatography using a mixture of methylene chloride and methanol (95/5) as an eluent.

Synthesis of bis-azo compound (Y4)

7 g of compound (IIIB) dissolved in a mixture of 40 ml of acetone and 5 ml of hydrochloric acid was diazotized with a solution of 1.5 g of sodium nitrite in 3 ml of water. The reaction mixture was stirred at 5° C. for 1 h. Urea was added in order to decompose excess of nitrite. The diazonium salt solution was added at 5° C. to a solution of 7 g of compound (VIB) in 50 ml of methanol whereto 1 g of potassium hydroxide was added. The reaction mixture was stirred at 5° C. for 1 h whereupon 30 ml of water was added. The precipitate formed was suction-filtered, washed with water and dried. Yield: 8 g of product that was purified by column chromatography by means of a mixture of methylene chloride and ethyl acetate (90/10) as an eluent.

Yield: 0.8 g. Purity was checked by thin-layer chromatography (methylene chloride/methanol (95/5); only traces of impurities were detected.

An example of a preparation of cyan IHR-quinonoid compounds is illustrated by the following reaction scheme followed in preparation 3.

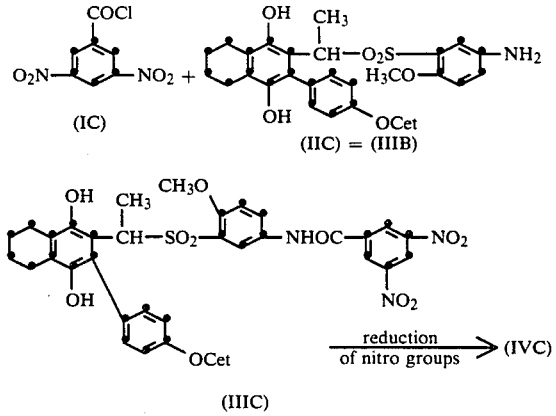

-continued

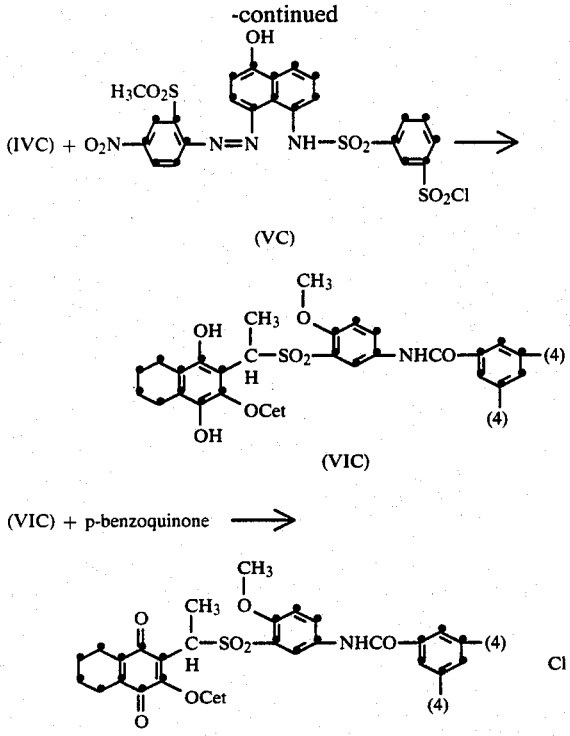

(4) has the meaning set forth in Table 1 hereinbefore, and Cet is —n-$C_{16}H_{33}$.

Preparation 3

Synthesis of 3,5-dinitro-benzoyl chloride (IC)

15 g of 3,5-dinitro-benzoic acid was mixed with 16.5 g of phosphorus(V) chloride and heated on an oil-bath at 120°-130° C. with stirring effecting co-melting for 75 min. From the cooled reaction mixture the phosphorus oxychloride formed was distilled at room temperature under reduced pressure.

Synthesis of compound (IIIC)

40.7 g of compound (IIC) being identical to the already described compound (IIIB) was mixed with 29.5 g of anhydrous sodium hydrogen carbonate in 250 ml of acetone and thereto the acid chloride (IC) dissolved in 50 ml of acetone was added dropwise. The temperature rose to about 30° C. The reaction mixture was stirred for another hour. The reaction product settled was suction-filtered, washed twice with acetone and dried. The residue was stirred with water and the residual sodium hydrogen carbonate was removed by acidification with acetic acid to pH 5. The residue was suction-filtered, washed with water and dried.

Yield: 32 g of compound (IIIC).

Synthesis of compound (IVC)

32 g of compound (IIIC) was dissolved in 175 ml of ethylene glycol monomethyl ether and after addition of 0.75 ml of Raney-nickel dispersion the reduction of the nitro groups to amino groups proceeded at 75° C. with hydrogen under a pressure of 105.3 kg/sq.cm in a rocking autoclave. After 4 h hydrogen was used up to 103% of the theoretical value and the Raney-nickel was removed by filtering. To the filtrate 250 ml of water was added and the initially sticky precipitate was solidified by stirring in 250 ml of water. The solid was suction-filtered, washed with water and dried. Yield: 26 g.

Synthesis of compound (VIC)

1.5 g of compound (IVC) and 2.8 g of VC (prepared as described in U.S. Pat. No. 4,176,134) were stirred in a mixture of 30 ml of methylene chloride and 3 ml of anhydrous pyridine and refluxed for 6 h. The reaction mixture was then cooled to room temperature and poured into a mixture of 150 ml of water and 4 ml of concentrated hydrochloric acid. The methylene chloride was removed by evaporation under reduced pressure. The precipitate was suction-filtered, washed with water and dried. Yield: 4.3 g of crude product (VIC) still containing some compound (VC).

Synthesis of compound (Cl)

4.3 g of compound (VIC) and 0.35 g of p-benzoquinone were dissolved in 50 ml of methylene chloride and refluxed with stirring for 3 h. The cooled reaction mixture was filtered and the filtrate yielded a pure compound (Cl) by preparative column chromatography; a mixture of methylene chloride and methanol (95/5) was used as an eluent.

Another preparation of yellow IHR-quinonoid compounds is illustrated in the following reaction scheme followed in preparation 4.

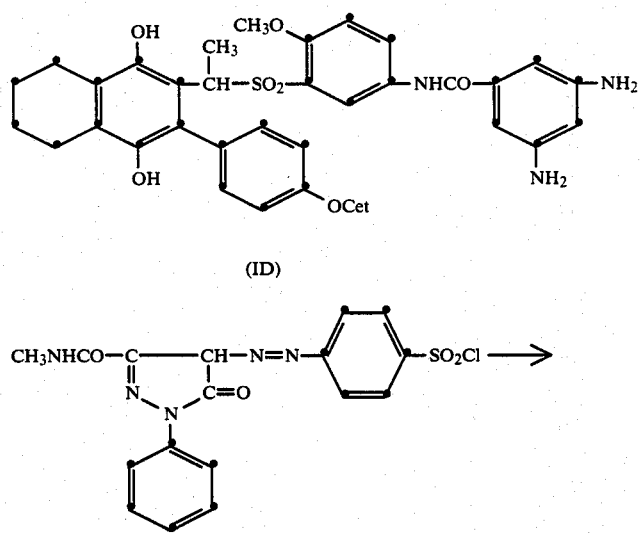

(IID) = (VB)

-continued

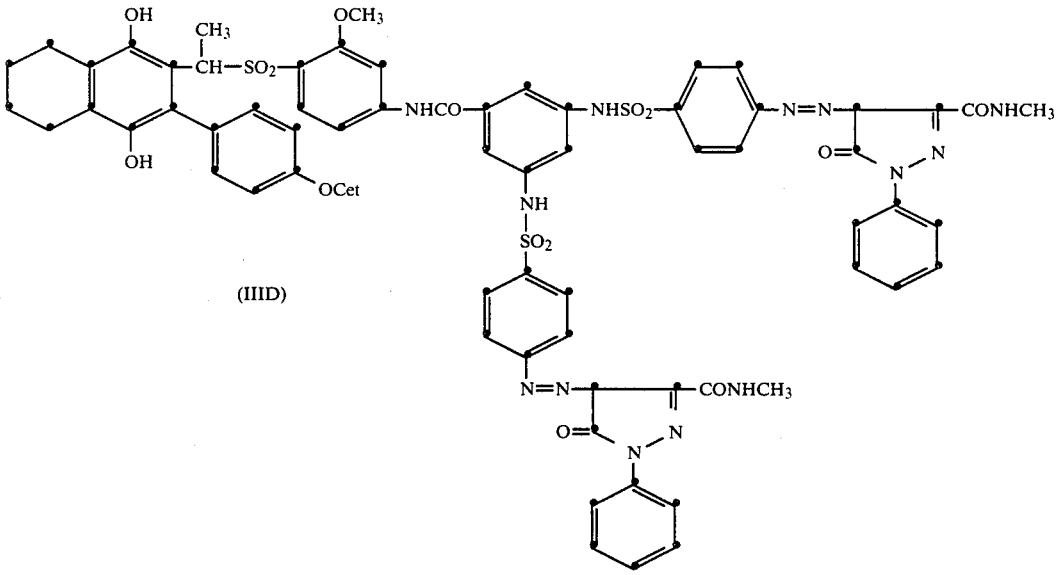

(IIID)

oxidation

IHR—quinonoid compound (Y5)

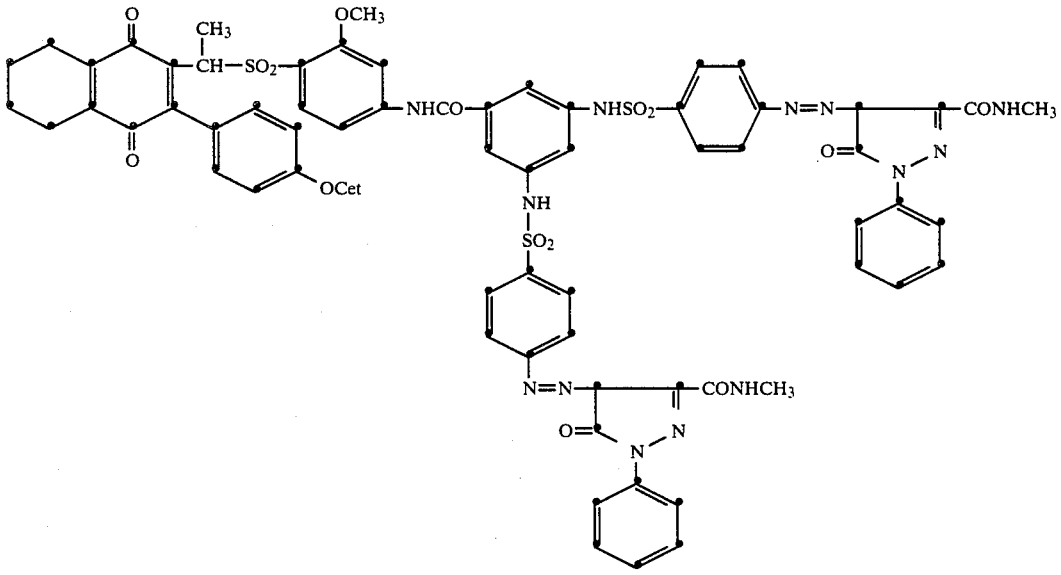

Preparation 4

Synthesis of compound (IIID)

3.8 g of compound (ID) being identical to compound (IVC) described hereinbefore and 4.8 g of compound (IID) were stirred in a mixture of 7.6 ml of anhydrous pyridine and 76 ml of methylene chloride and refluxed for 1 h. The reaction mixture was cooled to room temperature and poured into a mixture of 300 ml of water and 10 ml of concentrated hydrochloric acid.

The methylene chloride was removed by evaporation under reduced pressure. The precipitate was suction-filtered, washed with water and dried. Yield: 6.8 g of pure product (IIID).

Synthesis of compound (Y5)

3.4 g of the hydroquinone compound (IIID) was oxidized to the corresponding quinone by oxidation with 5 g of manganese (IV) oxide in 50 ml of methylene chloride and refluxed for 1 h with stirring. After cooling, the residual manganese (IV) oxide was filtered off and pure compound (Y5) was obtained after evaporation and washing of the residue with methanol.

A way for the preparation of magenta IHR-quinonoid compounds is illustrated in the following reaction scheme followed in preparation 5.

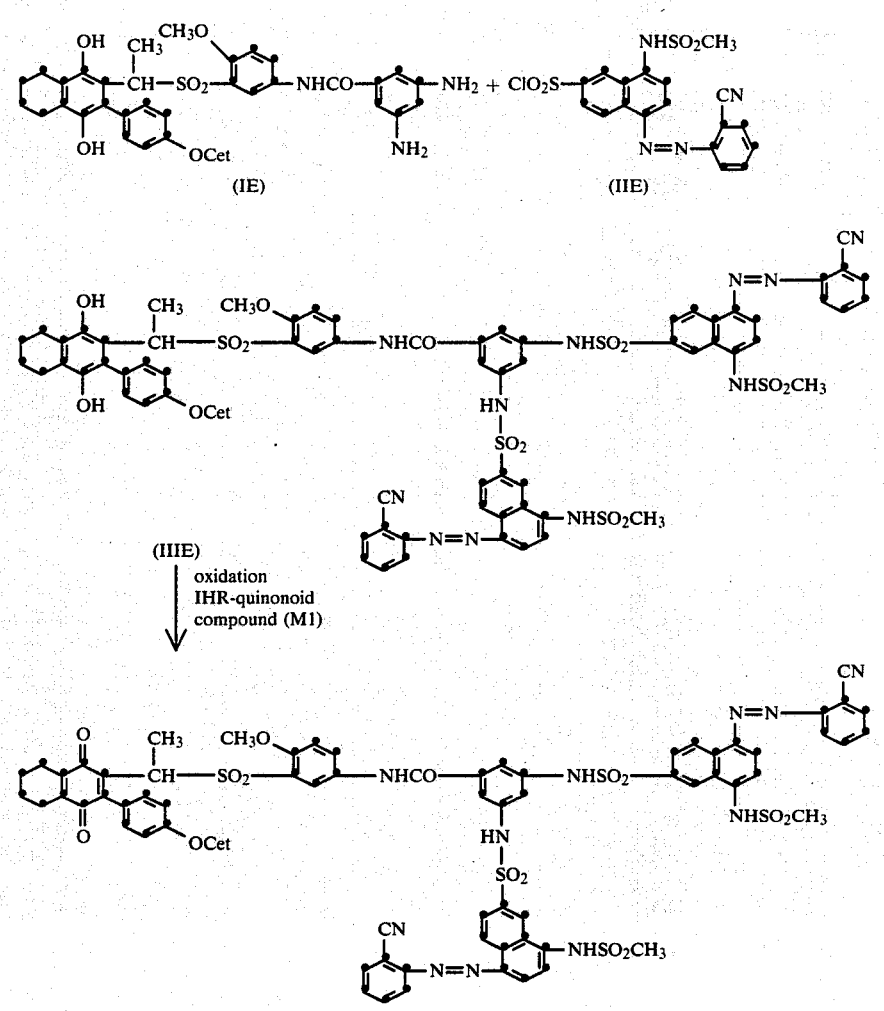

Preparation 5

Compound (IIE) was prepared as described in published U.S. Pat. No. 4,371,604.

Synthesis of compound (IIIE)

6 g of compound (IE) being identical to compound (IVC) described hereinbefore and 8.2 g of compound (IIE) were stirred in a mixture of 15 ml of anhydrous pyridine and 180 ml of methylene chloride and refluxed for 1 h. The reaction mixture was cooled to room temperature and poured into a mixture of 300 ml of water and 19 ml of concentrated hydrochloric acid.

The methylene chloride was removed by evaporation under reduced pressure. The precipitate was suction-filtered, washed with water and dried. Yield: 13.5 g of crude product (IIIE) still containing some compound (IIE).

Synthesis of compound (M1)

13.5 g of the hydroquinone compound (IIIE) was mixed with 3.5 g of p-benzoquinone serving as oxidizing agent in 130 ml of methylene chloride and refluxed for 4 h with stirring. Thereupon the methylene chloride was removed by evaporation under reduced pressure and the residue was dried in a ventilated stove. Pure compound (M1) was obtained by preparative column chromatography by means of a mixture of methylene chloride and methanol (95/5) as an eluent.

Another example of a preparation of magenta IHR-quinonoid compound is illustrated in the following scheme followed in preparation 6.

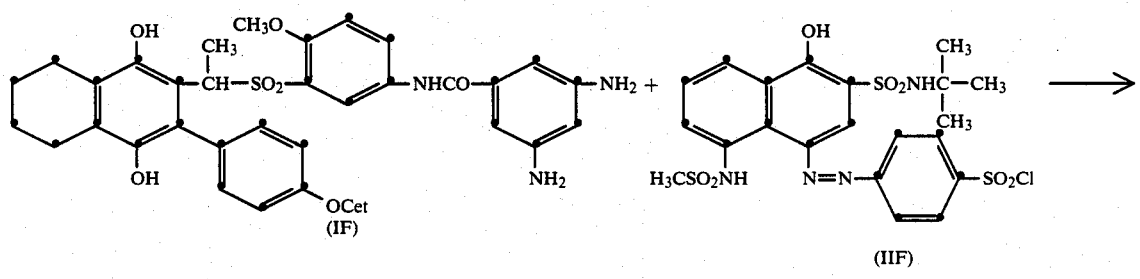

-continued

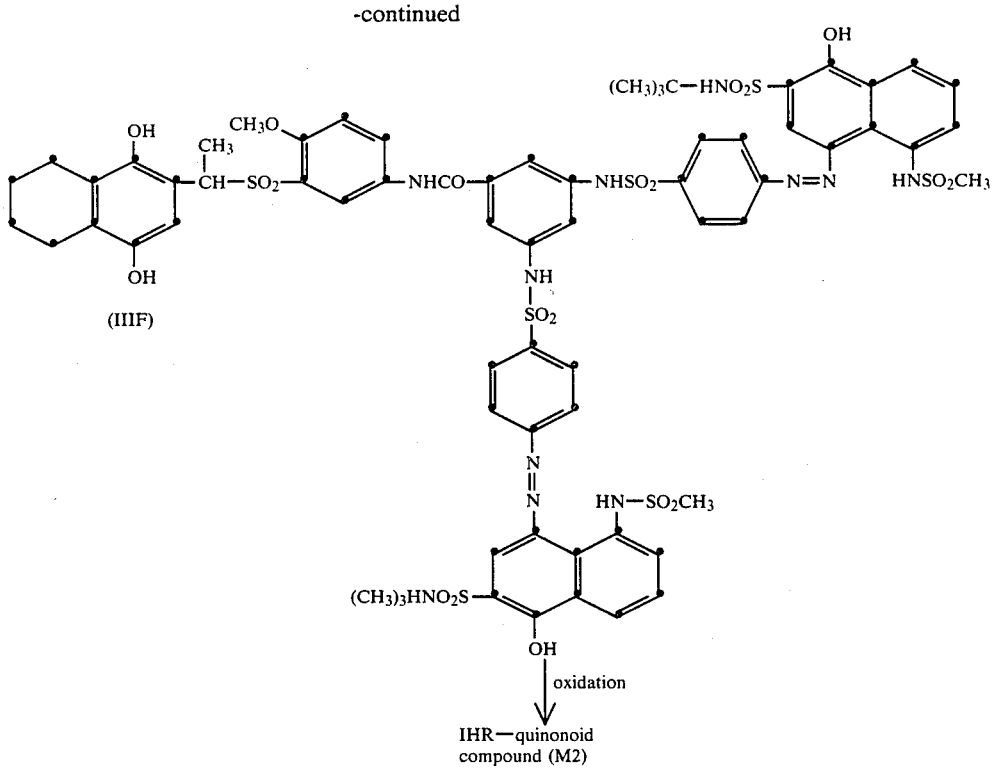

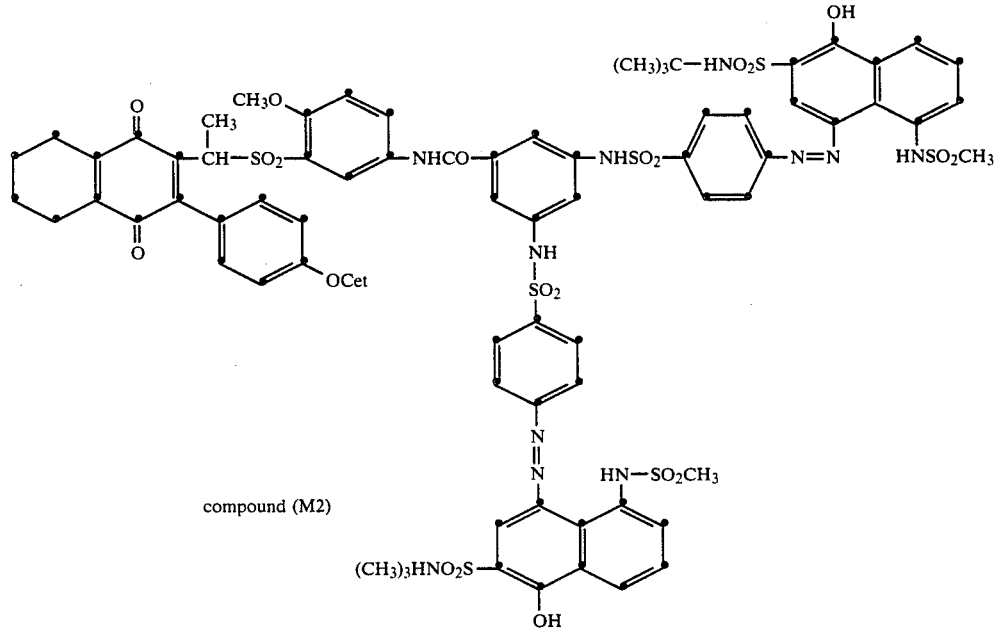

Preparation 6

Compound (IIF) was synthesized as described in U.S. Pat. No. 4,269,924.

Synthesis of compound (IIIF)

1.5 g of compound (IF) being identical to compound (IVC) described hereinbefore, and 2.6 g of compound (IIF) were stirred in a mixture of 3 ml of anhydrous pyridine and 30 ml of methylene chloride and refluxed for 2 h. The reaction mixture was cooled to room temperature and poured into a mixture of 150 ml of water and 4 ml of concentrated hydrochloric acid. The methylene chloride was removed by evaporation under reduced pressure. The precipitate was suction-filtered, washed with water and dried.

Yield: 4.1 g of crude product (IIIF) still containing some compound (IIF).

Synthesis of compound (M2)

4.1 g of the hydroquinone compound (IIIF) was mixed in 50 ml of methylene chloride with 4 g of manganese (IV) oxide and the reaction mixture was refluxed for 1 h with stirring. After cooling the residual manganese (IV) oxide was suction-filtered and pure compound (M2) was obtained by preparatory column chromatography by means of a mixture methylene chloride and methanol (90/10) as an eluent.

Other compounds according to the present invention having other carrier moieties and/or dye part units can be prepared analogously or by techniques known in the art starting with the appropriate chemicals.

The compounds according to the present invention are applied in a dye diffusion transfer process and for that purpose are used in operative contact with a light-sensitive silver halide emulsion layer, preferably of the negative-working type, i.e. of the type obtaining a silver image in the photo-exposed areas.

For monochrome dye image production a photographic silver halide emulsion material according to the present invention comprises a support carrying at least one alkali-permeable silver halide hydrophilic colloid emulsion layer having in operative contact therewith one of said compounds.

By "operative contact" is understood that the release of a diffusible dye moiety, e.g. polyazo dye, from the compound can proceed in accodance with the development of the silver halide emulsion layer. Therefore, the dye-releasing compound has not necessarily to be present in the silver halide emulsion layer but may be contained in another layer being in water-permeable relationship therewith.

In an embodiment for producing multicolour images this invention relates to photographic materials that comprise a support carrying (1) a red-sensitive silver halide emulsion layer having operatively associated therewith a said dye-releasing compound that is initially immobile in an alkali-permeable colloid medium and wherefrom through the reducing action of a silver halide developing agent and alkalinity a cyan dye is split off in diffusible state, (2) a green-sensitive silver halide emulsion layer having operatively associated therewith a said compound of (1) with the difference that a magenta dye is split off in diffusible state, and (3) a blue-sensitive silver halide emulsion layer having operatively associated therewith a said compound of (1) with the difference that a yellow dye is split off in diffusible state. In the present colour-providing compounds the dye group(s) may be associated with substituents that form a shifted dye.

Shifted dyes as mentioned, e.g., in U.S. Pat. No. 3,260,597 include those compounds wherein the light-absorption characteristics are shifted hypsochromically or bathochromically when subjected to a different environment such as a change of the $pK_a$ of the compound, or removal of a group such as a hydrolyzable acyl group linked to an atom of the chromophoric system and affecting the chromophore resonance structure. The shifted dyes can be incorporated directly in a silver halide emulsion layer or even on the exposure side thereof without substantial absorption of light used in recording. After exposure, the dye is shifted to the appropriate colour, e.g. by hydrolytic removal of said acyl group.

It is preferred to carry out the colour diffusion transfer process with the present coloured IHR-quinonoid compounds in conjunction with a mixture of reducing agents at least two of which being a compound called electron donor (ED-compound) and a compound called electron-transfer agent (ETA-compound) respectively.

The ED-compounds are preferably non-diffusing, e.g. are provided with a ballasting group, so that they remain within the layer unit wherein they have to transfer their electrons to the quinonoid compound.

The ED-compound is preferably present in non-diffusible state in each silver halide emulsion layer containing a different non-diffusible coloured IHR-quinonoid compound. Examples of such ED-compounds are ascorbyl palmitate and 2,5-bis(1',1',3',3'-tetramethylbutyl)-hydroquinone. Other ED-compounds are disclosed in U.S. Pat. No. 4,139,379 and in published DE-A No. 2,947,425. Instead of an ED-compound an electron-donor precursor (EDP) compound can be used in the photographic material as described e.g. in published DE-A No. 2,809,716 and in U.S. Pat. No. 4,278,750. Particularly useful ED-precursor compounds for combination with the present IHR compounds are disclosed in EP-A No. 83.200.353.7 and in published DE-A No. 3,006,268, which in the latter case correspond to the following general formula:

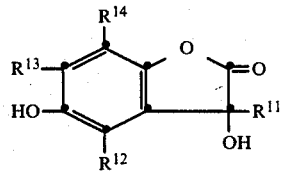

wherein:

$R^{11}$ represents a carbocyclic or heterocyclic aromatic ring, each of $R^{12}$, $R^{13}$ and $R^{14}$ (same or different) represents hydrogen, alkyl, alkenyl, aryl, alkoxy, alkylthio, amino, or $R^{13}$ and $R^{14}$ together represent an adjacent ring, e.g. carbocyclic ring, at least one of $R^{11}$, $R^{12}$, $R^{13}$ and $R^{14}$ representing a ballast group having from 10 to 22 carbon atoms.

The ETA-compound is preferably used as developing agent in diffusible state and is, e.g., incorporated in mobile form in (a) hydrophilic colloid layer(s) adjacent to one or more silver halide emulsion layers or applied from the processing liquid for the dye diffusion transfer.

Typically useful ETA-compounds include hydroquinone compounds, aminophenol compounds, catechol compounds, phenylenediamines and 3-pyrazolidinone compounds e.g. 1-aryl-3-pyrazolidinone as defined, e.g., in U.S. Pat. No. 4,139,379.

A combination of different ETA's such as those disclosed in U.S. Pat. No. 3,039,869 can be employed likewise. Such developing agents can be used in the liquid processing composition or may be contained, at least in part, in any layer or layers of the photographic element or film unit such as the silver halide emulsion layers, the dye image-providing material layers, interlayers, image-receiving layer, etc. The particular ETA selected will, of course, depend on the particular electron donor and quinonoid compound used in the process and the processing conditions for the particular photographic element.

The concentration of ED-compound or ED-precursor compound in the photographic material may vary within a broad range but is, e.g., in the molar range of 1:1 to 8:1 with respect to the quinonoid compound. The ETA-compound may be present in the alkaline aqueous liquid used in the development step, but is used preferably in diffusible form in a non-sensitive hydrophilic colloid layer adjacent to at least one silver halide emulsion layer.

Migration of non-oxidized developing agent, e.g. acting as ETA-compound, proceeds non-image-wise and has an adverse effect on correct colour rendering when surplus developing agent remains unoxidized in the photoexposed areas of a negative-working emulsion layer. Therefore, according to a preferred embodiment of the present invention a silver halide solvent, e.g. thiosulphate, is used to mobilize unexposed silver halide in complexed form for helping to neutralize (i.e. oxidize by physical development) migrated developing agent in the photoexposed areas wherein unaffected developing agent (ETA-compound) should no longer be available for reacting with the quinonoid compound directly or through the applied ED-compound. The use of silver halide solvents for that purpose has been described in the published EP-A No. 0049002.

In order to obtain a better colour rendition it is also advantageous to intercept oxidized ETA-compound and to prevent if from migrating to adjacent imaging layers where it could cause the undesired oxidation of ED-compound. For said interception so-called scavengers are used that are incorporated in the photographic material in non-diffusible state, e.g. in interlayers between the imaging layers. Suitable scavengers for that purpose are described, e.g., in U.S. Pat. No. 4,205,987 and EP-A No. 0,029,546.

The present dye releasing compounds and optionally ED or EDP-compounds can be incorporated in the photographic material by addition to the coating liquid(s) of its layer(s) by the usual methods known, e.g., for the incorporation of colour couplers in photographic silver halide emulsion materials.

The amount of dye-releasing compound coated per sq.m may vary within wide limits and depends on the maximum colour density desired.

The support for the photographic elements of this invention may be any material as long as it does not deleteriously affect the photographic properties of the film unit and is dimensionally stable. Typical flexible sheet materials are paper supports, e.g. coated at one or both sides with an α-olefin polymer, e.g. polyethylene; they include cellulose nitrate film, cellulose acetate film, poly(vinyl acetal) film, polystyrene film, poly(ethylene terephthalate) film, polycarbonate film, poly-α-olefins such as polyethylene and polypropylene film, and related films or resinous materials. The support is usually about 0.05 to 0.15 mm thick.

The image-receiving layer can form part of a separate image-receiving material or form an integral combination with the light-sensitive layer(s) of the photographic material.

Where the image-receiving layer after processing of the photosensitive material remains associated with the silver halide emulsion layer(s) normally an alkali-permeable light-shielding layer, e.g. containing white pigment particles is applied between the image-receiving layer and the silver halide emulsion layer(s).

For use in dye diffusion transfer photography any material may be employed as the image-receiving layer as long as the desired function of mordanting or otherwise fixing the diffused dye will be obtained. The particular material chosen will, of course, depend upon the dye to be mordanted. If acid dyes are to be mordanted, the image-receiving layer may be composed of or contain basic polymeric mordants such as polymers of amino-guanidine derivatives of vinyl methyl ketone such as described in U.S. Pat. No. 2,882,156 of Louis M. Minsk, issued Apr. 14, 1959, and basic polymeric mordants and derivatives, e.g. poly-4-vinylpyridine, the metho-p-toluene sulphonate of 2-vinylpyridine and similar compounds described in U.S. Pat. No. 2,484,430 of Robert H. Sprague and Leslie G. Brooker, issued Oct. 11, 1949, and the compounds described in the published DE-A No. 2,200,063 filed Jan. 11, 1971 by Agfa-Gevaert A.G. Suitable mordanting binders include, e.g., quanylhydrazone derivatives of acyl styrene polymers, as described, e.g., in published DE-A No. 2,009,498 filed Feb. 28, 1970 by Agfa-Gevaert A.G. In general, however, other binders, e.g. gelatin, would be added to the last-mentioned mordanting binders. Effective mordanting compositions are long-chain quaternary ammonium or phosphonium compounds or ternary sulphonium compounds, e.g. those described in U.S. Pat. No. 3,271,147 of Walter M. Bush and 3,271,148 of Keith E. Whitmore, both issued Sept. 6, 1966, and cetyltrimethyl-ammonium bromide. Certain metal salts and their hydroxides that form sparingly soluble compounds with the acid dyes may be used too. The dye mordants are dispersed in one of the usual hydrophilic binders in the image-receiving layer, e.g. in gelatin, polyvinylpyrrolidone or partly or completely hydrolysed cellulose esters.

Generally, good results are obtained when the image-receiving layer, which is preferably permeable to alkaline solution, is transparent and about 4 to about 10 μm thick. This thickness, of course, can be modified depending upon the result desired. The image-receiving layer may also contain ultraviolet-absorbing materials to protect the mordanted dye images from fading, brightening agents such as the stilbenes, coumarins, triazines, oxazoles, dye stabilizers such as the chromanols, alkyl-phenols, etc.

Use of pH-lowering material in the dye-image-receiving element will usually increase the stability of the transferred image. Generally, the pH-lowering material will effect a reduction of the pH of the image layer from about 13 or 14 to at least 11 and preferably 5 to 7 within a short time after imbibition. E.g., polymeric acids as disclosed in U.S. Pat. No. 3,362,819 of Edwin H. Land, issued Jan. 9, 1968, or solid acids or metal salts, e.g. zinc acetate, zinc sulphate, magnesium acetate, etc., as disclosed in U.S. Pat. No. 2,584,030 of Edwin H. Land, issued Jan. 29, 1952, may be employed with good results. Such pH-lowering materials reduce the pH of the film unit after development to terminate development and substantially reduce further dye transfer and thus stabilize the dye image.

An inert timing or spacer layer may be employed over the pH-lowering layer, which "times" or controls the pH reduction depending on the rate at which alkali diffuses through the inert spacer layer. Examples of such timing layers include gelatin, polyvinyl alcohol or any of the colloids disclosed in U.S. Pat. No. 3,455,686 of Leonard C. Farney, Howard G. Rogers and Richard W. Young, issued July 15, 1969. The timing layer may be effective in evening out the various reaction rates over a wide range of temperatures, e.g., premature pH reduction is prevented when imbibition is effected at temperatures above room temperature, e.g. at 35° to 37° C. The timing layer is usually about 2.5 μm to about 18 μm thick. Especially good results are obtained if the timing layer comprises a hydrolysable polymer or a mixture of such polymers that are slowly hydrolysed by the processing composition. Examples of such hydrolysable polymers include polyvinyl acetate, polyamides, cellulose esters, etc.

An alkaline processing composition employed in the production of dye images according to the present invention may be a conventional aqueous solution of an alkaline material, e.g. sodium hydroxide, sodium carbonate or an amine such as diethylamine, preferably possessing a pH beyond 11.

According to one embodiment the alkaline processing liquid contains the diffusible developing agent that effects the reduction of the silver halide, e.g. ascorbic acid or a 3-pyrazolidinone developing agent such as 1-phenyl-4-methyl-3-pyrazolidinone.

The alkaline processing composition employed in this invention may also contain a desensitizing agent such as methylene blue, nitro-substituted heterocyclic compounds, 4,4'-bipyridinium salts, etc., to insure that the photosensitive element is not further exposed after its removal from the camera for processing.

For in-camera-processing, the solution also preferably contains a viscosity-increasing compound such as a high-molecular-weight polymer, e.g. a water-soluble ether inert to alkaline solutions such as hydroxyethylcellulose or alkali metal salts of carboxymethylcellulose such as sodium carboxymethylcellulose. A concentration of viscosity-increasing compound of about 1 to about 5% by weight of the processing composition is preferred. It imparts thereto a viscosity of about 100 mPa.s to about 200,000 mPa.s.

Although the common purpose in the known dye-diffusion transfer systems is the production of dye images in a receiving layer or sheet whereby the released dye(s) are eliminated from the photosensitive element by diffusion transfer, a residual image of dye may be likewise of practical interest forming a so-called "retained image". The latter terminology is used, e.g., in Research Disclosure (No. 17362) of September 1978 and a dye-diffusion process relating thereto is exemplified in Research Disclosure (No. 22711) of March 1983.

Processing may proceed in a tray developing unit as is contained, e.g., in an ordinary silver complex diffusion transfer (DTR) apparatus in which contacting with a separate dye image-receiving material is effected after a sufficient absorption of processing liquid by the photographic material has taken place. A suitable apparatus for said purpose is the COPYPROOF CP 38 (trade name) DTR-developing apparatus. COPYPROOF is a trade name of Agfa-Gevaert, Antwerp/Leverkusen.

According to an embodiment wherein the image-receiving layer is integral with the photosensitive layer(s), the processing liquid is applied from a rupturable container or by spraying.

A rupturable container that may be employed is e.g. of the type disclosed in U.S. Pat. Nos. 2,543,181 of Edwin H. Land, issued Feb. 27, 1951, 2,643,886 of Ulrich L. di Ghilini, issued June 30, 1953, 2,653,732 of Edwin H. Land, issued Sept. 29, 1953, 2,723,051 of William J. McCune Jr., issued Nov. 8, 1955, 3,056,492 and 3,056,491, both of John E. Campbell, issued Oct. 2, 1962, and 3,152,515 of Edwin H. Land, issued Oct. 13, 1964. In general, such containers comprise a rectangular sheet of fluid- and air-impervious material folded longitudinally upon itself to form two walls that are sealed to one another along their longitudinal and end margins to form a cavity in which processing solution is contained.

The following examples further illustrate the present invention. All percentages and ratios are by weight, unless otherwise mentioned.

EXAMPLE 1

(Comparative Example)

Material A (1) Preparation of coating composition A containing yellow dye-releasing compound:

silver chloride emulsion having a AgCl content equivalent to 136 g of silver nitrate per kg and a gelatin/silver nitrate ratio of 0.82:

dispersion of yellow mono-azo IHR-compound R1 with structural formula as given at the end of the example and prepared in analogy to procedures described in U.S. Pat. No. 4,371,604: 260 g dispersion of electron donor precursor EDP-1 of structural formula described hereinafter: 144 g The above coating composition A was applied at a coverage of 48 g per sq.m to a transparent subbed polyethylene terephthalate film support whereby the yellow-dye-releasing compound R1 was present at 0.525 g or 0.572 mmol per sq.m.

Preparation of the dispersion of the yellow dye releasing IHR-compound R1.

10 g of said IHR-compound R1 was dissolved in ethyl acetate and dispersed by high-speed stirring in a mixture of:

gelatin: 15 g

MARLON A-396 (trade name): 10 ml water to make: 160 ml

MARLON A-396 is a trade name of Chemische Werke Hüls AG, Marl Westfalen, W. Germany for a wetting agent of the following formula:

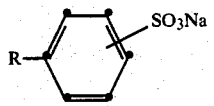

wherein R is a $C_{10}$–$C_{13}$ alkyl group.

After the pre-dispersion was obtained, the ethyl acetate was removed by evaporation under reduced pressure and water was added to make 200 g.

Preparation of the dispersion of EDP-1.

200 g of EDP-1 were dissolved in ethyl acetate and dispersed in 3 l of water in the presence of 300 g of gelatin and 100 ml of MARLON A-396 (trade name). Thereupon the ethyl acetate was removed by evaporation under reduced pressure and water was added up to a total amount of 4 kg of composition.

Structural formula of EDP-1:

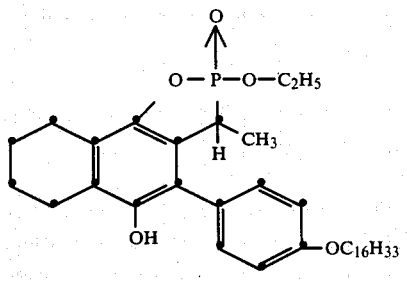

(prepared according to U.S. Pat. No. 4,537,853).

(2) Preparation of the coating composition B containing a silver halide developing agent:

20% aqueous gelatin solution: 400 g dispersion of 1-phenyl-4-methyl-3-pyrazolidinone: 8 g 10% aqueous citric acid solution: 100 g wetting agent: 16 g

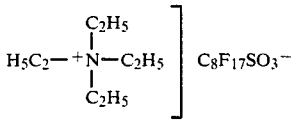

demineralized water to make: 1 kg

The above coating composition B was applied at 75 g per sq.m to the dried coating A.

Preparation of the dispersion of 1-phenyl-4-methyl-pyrazolidinone.

In aqueous medium 200 g of 1-phenyl-4-methyl-3-pyrazolidinone was sand-milled, whereupon 100 g of gelatin and a sufficient amount of water were added so as to make 1 kg of dispersion.

Processing

The dried photographic material was exposed through a step-wedge having a constant 0.15. Two of the same exposed strips were processed in contact for 5 min with receptor materials X and Y respectively (composition as described hereinafter) in the COPYPROOF CP 38 (trade name) diffusion transfer processing apparatus containing in its tray an aqueus solution comprising per liter:

sodium hydroxide: 25 g trisodium phosphate: 25 g sodium bromide: 2 g sodium thiosulphate: 2 g cyclohexane dimethanol: 25 g methyl-propyl-propane diol: 25 g potassium iodide: 2 g distilled water to make: 1 liter.

Composition of the receptor material X.

A reflective polyethylene coated paper base (paper sheet of 110 g/sq.m coated at both sides with a polyethylene stratum of 15 g/sq.m) was corona-discharge-treated and coated with the following composition applied per sq.m:

gelatin: 5 g triphenyl-n-hexadecylphosphonium bromide: 2 g

Composition of the receptor material Y

The receptor material Y had the same composition as receptor material X with the difference, however, that the paper base was replaced by a transparent subbed polyethylene terephthalate film support.

(4) Measurements

The colour density measurements proceeded in reflex on receptor material X and in projection or transmission on receptor material Y using MACBETH (trade name) Densitometer RD 919 and RD 102 respectively, both being provided with a filter transmittng blue light.

Results

Maximum density in reflex: 1.76

Maximum density in transmission: 0.86

Structural formula of IHR-compound R1:

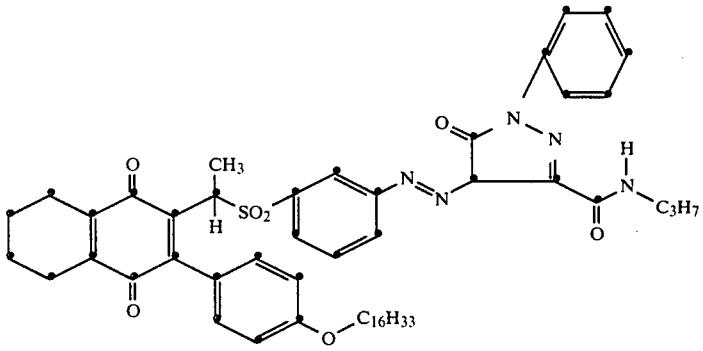

EXAMPLE 2

(According to the Invention)

Material B

The composition of material B was the same as that of material A with the difference that the yellow-dye-releasing IHR-compound R1 was replaced by half the molar amount per sq.m of yellow IHR-compound Y2, i.e. 0.285 mmol per sq.m. In the preparation of the coating composition A 16 g of a dispersion of the ED-compound 2,5-bis(1',1',3',3'-tetramethylbutyl)-hydroquinone was added.

The coating composition B was identical to that described in Example 1.

Preparation of the dispersion of yellow bis-azo quinonoid compound Y2

8 g of said compound Y2 was sand-milled with water whereto 5 ml of a 40% aqueous solution of LOMAR D (trade name of Nopco Chemical Company, Newark, N.J., U.S.A. for a wetting agent being a naphthalene sulphonate condensate, wherein formaldehyde is used in the condensation reaction) had been added.

After the dispersion was obtained, 8 g of gelatin was added as well as an amount of water up to a total weight of 160 g.

Preparation of the dispersion of 2,5-bis(1',1',3',3'-tetramethylbutyl)-hydroquinone (reductor ED)

500 g of reductor ED together with 500 g of tricresyl phosphate and 500 ml of a 5% aqueous solution of NEKAL BX (trade name of BASF, W.-Germany, for sodium 1,6-di-isobutyl-naphthalene-3-sulphonate) were dispersed by high speed stirring. Thereupon 250 g of gelatin and a sufficient amount of distilled water up to a total weight of 5 kg of composition were added.

Processing and measurement proceeded as described in Example 1.

Results

Maximum density in reflex: 1.95

Maximum density in transmission: 0.96

EXAMPLE 3

(According to the Invention)

Material C

The composition of material C was the same as that of material B with the difference that 0.570 mmol of the yellow bis-azo IHR-compound Y2 instead of 0.285 mmol were used per sq.m.

Processing and measurements proceeded as described in Example 1.

Results

Maximum density in transmission: 1.65

EXAMPLE 4

(According to the Invention)

Material D

The composition of material D was the same as that of material A with the difference, however, that in coating composition A the dispersion of yellow IHR-compound R1 was replaced by 200 g of a 5% dispersion of a yellow IHR-compound Y1, prepared according to Preparation 1. In the preparation of the coating composition A, 116 g of the dispersion of electron-donor precursor EDP-1 (see Example 1) and sufficient water were used so as to make 1 kg of composition.

From that modified coating composition A 40 g was coated per sq.m, so that 0.400 g per sq.m corresponding with 0.310 mmol of said yellow IHR-compound Y1 was applied per sq.m.

The coating composition B was identical to that described in Example 1.

Preparation of the dispersion of the yellow bis-azo IHR-quinonoid compound Y1.

4 g of said compound Y1 was sand-milled with water whereto 2.5 ml of a 40% aqueous solution of LOMAR D (trade name) was added. After the dispersion was obtained, 4 g of gelatin and sufficient water up to a total weight of 80 g were added.

Results

Maximum density in transmission: 1.81

EXAMPLE 5

(According to the Invention)

Material E

The composition of material E was the same as that of material A with the difference, however, that in coating composition A only 31 g of silver chloride emulsion was used and the dispersion of yellow IHR-compound R1 was replaced by 120 g of dispersion (prepared as described hereinafter) of the yellow IHR-compound Y4 (prepared according to Preparation 2).

In the preparation of coating composition A, 16 g of dispersion of the ED-compound 2,5-bis(1',1',3',3'-tetramethylbutyl)-hydroquinone was added instead of the dispersion of EDP-1. The modified coating composition A was coated at 60 g per sq.m so that 0.360 g per sq.m corresponding with 0.285 mmol per sq.m of said IHR-compound Y4 was present.

Preparation of the dispersion of yellow IHR-compound Y4.

0.7 g of said compound Y4 was dissolved in ethyl acetate and with the aid of 0.3 ml of MARLON-A 396 (trade name) as wetting agent dispersed in 10 ml of water. After the pre-dispersion was obtained, the ethyl acetate was removed by evaporation under reduced pressure whereupon sufficient water was added up to a total amount of 14 g of composition.

Processing and measurement proceeded as described in Example 1, the transfer time, however, lasting only 60 s.

Results

Maximum density in reflex: 1.72.

After 60 s the maximum density in reflex obtained according to Example 1 amounted to only 1.66.

EXAMPLE 6

(According to the Invention)

Material F

The composition of material F was the same as that of material A with the difference, however, that in coating composition A only 31 g of silver chloride emulsion was used and the dispersion of yellow mono-azo IHR-compound R1 was replaced by 175 g of dispersion (prepared as described hereinafter) of the yellow tris-azo IHR-compound Y6.

In the preparation of the coating composition A 17.5 g of a 10.1% dispersion of the ED-compound 2,5-bis(1',1',3',3'-tetramethylbutyl)-hydroquinone was used instead of EDP-1.

The modified coating composition A was coated at 40 g per sq.m so that 0.350 g per sq.m corresponding with 0.200 mmol per sq.m of said IHR-compound Y6 was present.

The coating composition B was identical to that described in Example 1.

Processing and measurement proceeded as described in Example 1.

Results

Maximum density in reflex: 1.34

Structural formula of compound Y6

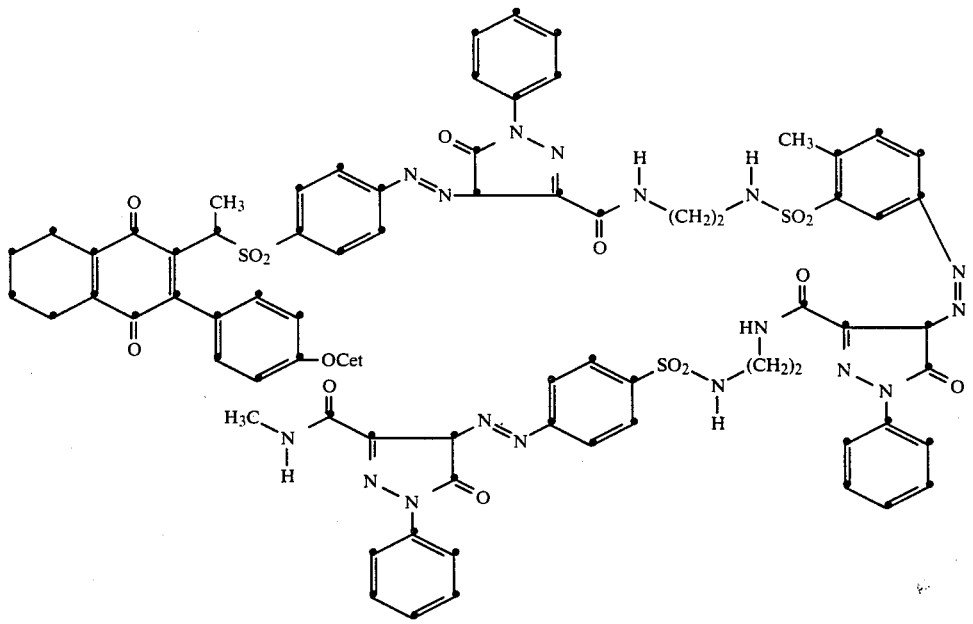

EXAMPLE 7

(Comparative Example)

Material G (1) Preparation of coating composition G containing magenta mono-azo IHR-compound R2:

silver chloride emulsion having a AgCl content equivalent to 136 g of silver nitrate per kg and a gelatin/silver nitrate ratio of 0.82: 62 g aqueous 20% gelatin solution: 83 g dispersion of magenta mono-azo IHR-quinonoid compound R2 (prepared as described hereinafter): 110 g dispersion of EDP-1 (see Example 1): 72 g demineralized water to make: 1 kg The above coating composition G was applied at a coverage of 60 g per sq.m to a transparent subbed polyethylene terephthalate support whereby the magenta IHR-compound R2 was present at 0.317 g per sq.m corresponding with 0.360 mmol per sq.m.

Preparation of the dispersion of magenta mono-azo IHR-compound R2 (preparation analogous to procedures described in EP 38092, structural formula at the end of example 7).

50 g of said IHR-compound R2 were dissolved in ethyl acetate and with the aid of 25 ml of MARLON A-396 (trade name) as a dispersing agent dispersed with high-speed stirring in water.

After the pre-dispersion was obtained, the ethyl acetate was removed by evaporation under reduced pressure and 75 g of gelatin as well as a sufficient amount of water were added so as to make 1 kg of dispersion.

(2) Preparation of the coating composition B containing a silver halide developing agent (see Example 1).

Processing and measurement proceeded as described in Example 1.

Results

Maximum density in reflex: 2.03.

Structural formula of IHR-compound R2:

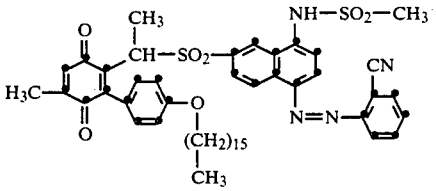

EXAMPLE 8

(According to the Invention)

(1) Preparation of coating composition H containing a magenta IHR-compound M1:

silver chloride emulsion having a AgCl content equivalent to 136 g of silver nitrate per kg and a gelatin to silver nitrate ratio of 0.82: 31 g aqueous 20% gelatin solution: 118 g dispersion of magenta bis-azo IHR-compound M1 (prepared according to Preparation 5): 98 g dispersion of EDP-1 (see Example 1): 36 g demineralized water up to: 1 kg The above coating composition H was applied at a coverage of 60 g per sq.m to a transparent subbed polyethylene terephthalate support whereby 0.295 g of magenta bis-azo IHR-compound M1 was present per sq.m corresponding with 0.178 mmol per sq.m.

Preparation of the dispersion of magenta IHR-compound H.

2.4 g of said IHR-compound M1 and 1.5 ml of LOMAR D (trade name) were sand-milled with water. After a dispersion was obtained, 2.4 g of gelatin as well as sufficient water were added up to a total weight of 48 g of composition.

Coating composition B was the same as described in Example 7.

Processing and measurement proceeded as described in Example 1.

Results

Maximum density in reflex: 1.63

EXAMPLE 9

(Comparative Example)

Material J (1) Preparation of coating composition J containing cyan mono-azo IHR-compound R3 silver chloride emulsion having a AgCl content equivalent to 135.9 g of silver nitrate per kg and a gelatin/silver nitrate ratio of 0.82: 62 g 20% aqueous gelatin solution: 72 g dispersion of cyan mono-azo IHR-quinonoid compound R3 (structural formula as given hereinafter and prepared by procedures analogous to those described in E-P 38092): 72 g dispersion of EDP-1 (see example 4): 55 g demineralized water to make: 1 kg The above coating composition J was applied at a coverage of 60 g per sq.m to a transparent subbed polyethylene terephthalate support whereby the cyan IHR-compound R3 was present at 0.220 g per sq.m corresponding with 0.228 mmol per sq.m.

(2) Preparation of the dispersion of cyan mono-azo compound $R^3$ 50 g of said cyano mono-azo IHR-compound R3 was dissolved in ethyl acetate and with the aid of 25 ml of MARLON A-396 (trade name) as a dispersing agent dispersed with high-speed stirring in water. After the pre-dispersion was obtained, the ethyl acetate was removed by evaporation under reduced pressure and 75 g of gelatin as well as sufficient water were added up to a total weight of 1 kg of composition.

The preparation of coating composition B was the same as in Example (1)

The processing and measurement proceeded as described in Example 1.

Results

Maximum density in reflex: 2.07.

Structural formula of IHR-compound R3:

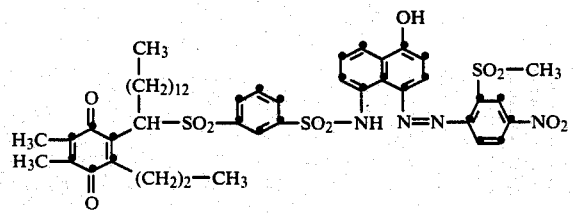

EXAMPLE 10

Material K (1) Preparation of coating composition K containing a cyan IHR-compound C1 silver chloride emulsion having a AgCl content equivalent to 136 g of silver nitrate per kg and a gelatin/silver nitrate ratio of 0.82: 31 g 20% aqueous gelatin solution: 130 g dispersion of cyan bis-azp IHR-compound C1 (prepared according to preparation 3): 76.6 g dispersion of EDP-1 (see example 4): 27 g demineralized water to make: 1 kg The above coating composition K was applied at a coverage of 60 g per sq.m to a transparent subbed polyethylene terephthalate support whereby the cyan bis-azo IHR-compound C1 was present at 0.230 g per sq.m corresponding with 0.114 mmol per sq.m.

(2) Preparation of the dispersion of cyan IHR-compound C1

0.8 g of said IHR-compound C1 and 0.5 l of LOMAR D (trade name) were sand-milled with water. After a dispersion was obtained, 0.8 g of gelatin and sufficient water were added up to a total weight of 16 g of composition.

Coating composition B was the same as described in Example 9.

Processing and measurement proceeded as described in Example 1.

Results

Maximum density in reflex: 2.12

We claim:

1. A photographic silver halide emulsion material which contains in operative contact with at least one alkali-permeable silver halide hydrophilic colloid emulsion layer a ballasted non-diffusing compound capable of releasing a diffusible dye or dye precursor corresponding to the following general formula:

CAR—L—D wherein:

CAR represents a carrier moiety,

L represents a chemical group cleavable or releasable from the carrier moiety by a redox-reaction in alkaline aqueous medium, and D represents a dye or dye precursor part containing:

(i) several dye units or dye precursor units that are linked chemically to each other by:

a non-metal atom bearing only single bonds, or a polyvalent atom group wherein one atom links the dye units together by single bonds only, or a polyvalent atom group forming between the dye units a chain of atoms wherein at least one atom of the interlinking atoms of the backbone part of said chain has two consecutive single bonds in said backbone part, and (ii) incorporating one or more groups that improve the diffusibility of the released dye part or dye precursor part in a hydrophilic colloid medium when permeated by an aqueous alkaline liquid.

2. Photographic material according to claim 1, wherein the group D corresponds to the following general formula:

$$-(A)_x[-B(-C)_y]_z$$

wherein:

A is $L^1$, $L^1D^1$ or $D^1$,

B is $L^2$, $L^2D^2$ or $D^2$,

C is $L^3$, $L^3D^3$ or $D^3$, x is 0 or 1, y is 0, 1, 2 or 3, and z is 1, 2 or 3, so that the above formula comprises at least 2 members selected from $D^1$, $D^2$ and $D^3$ and that when y and/or z are 2 or 3, both the several B-groups and the several C-groups have the same or different meaning, and wherein:

each of $L^1$, $L^2$ and $L^3$ (the same or different) represents:

a non-metal atom bearing only single bonds or a polyvalent atom group wherein one atom links the dye units together by single bonds only, or a polyvalent atom group forming between the dye units a chain of atoms wherein at least one atom of the interlinking atoms of the backbone part of said chain has two consecutive single bonds in said backbone part, and each of $D^1$, $D^2$ and $D^3$ (the same or different) represents a dye or dye precursor unit.

3. Photographic material according to claim 2, wherein said general formula comprises from 2 to 5 members selected from $D^1$, $D^2$ and $D^3$.

4. Photographic material according to claim 1, wherein the group D incorporates one or more groups that improve the diffusibility of the released dye part or dye precursor part in a hydrophilic colloid medium when permeated by an aqueous alkaline liquid, said groups being selected from the group consisting of hydroxyl, ether, thio-ether, carbonamido, sulphonamido, carbamoyl, sulphamoyl, onium, amino, sulphonyl, ureido, cyano, carboxylic acid, sulphinic acid, sulphonic acid, phosphonic acid and salts and ester groups derived from these acidic groups.

5. Photographic material according to claim 1, wherein the group D corresponds to one of the following structural formulae:

(1)

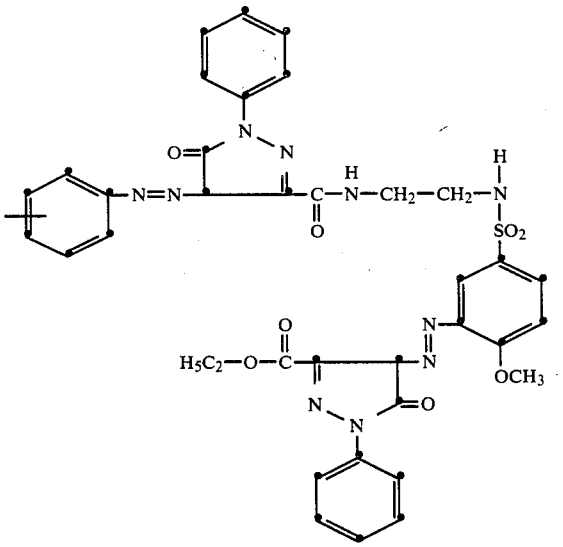

(2)

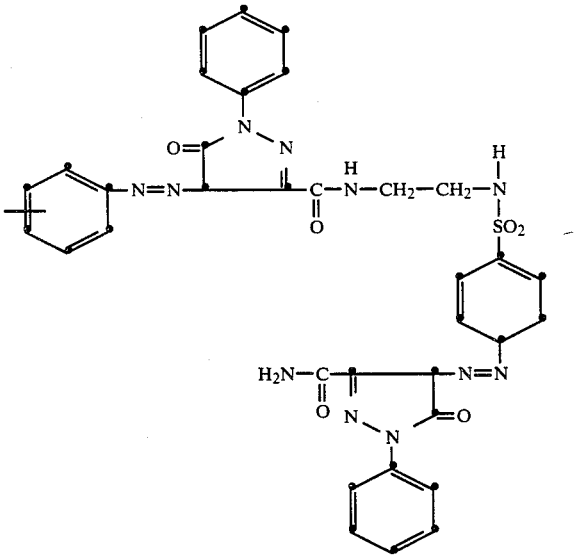

-continued
(3)
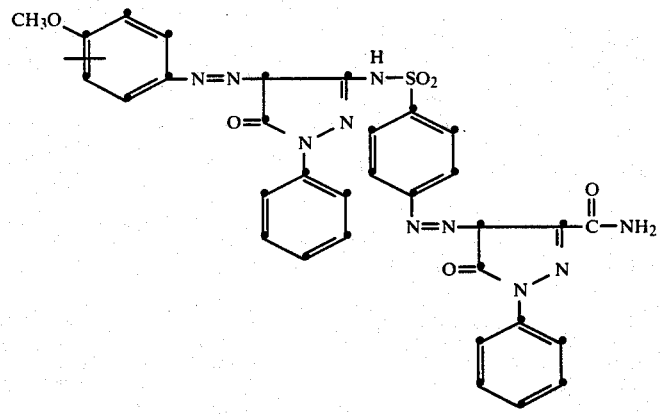
(4)
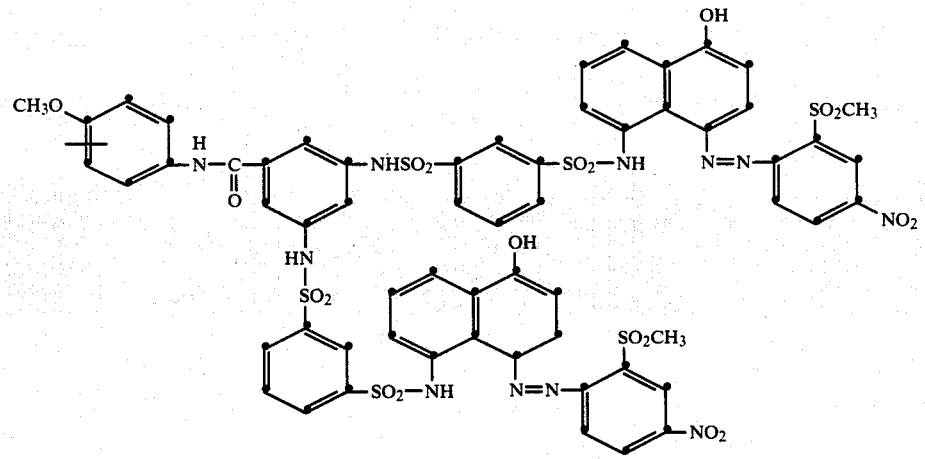
(5)
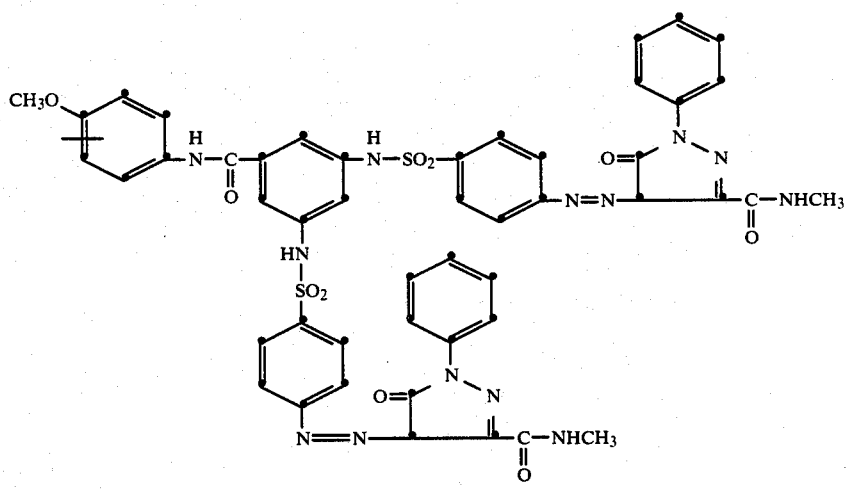
(6)
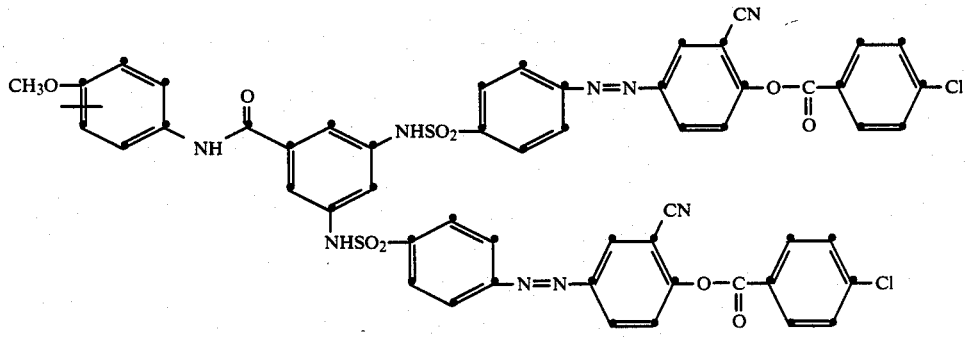

-continued
(7)
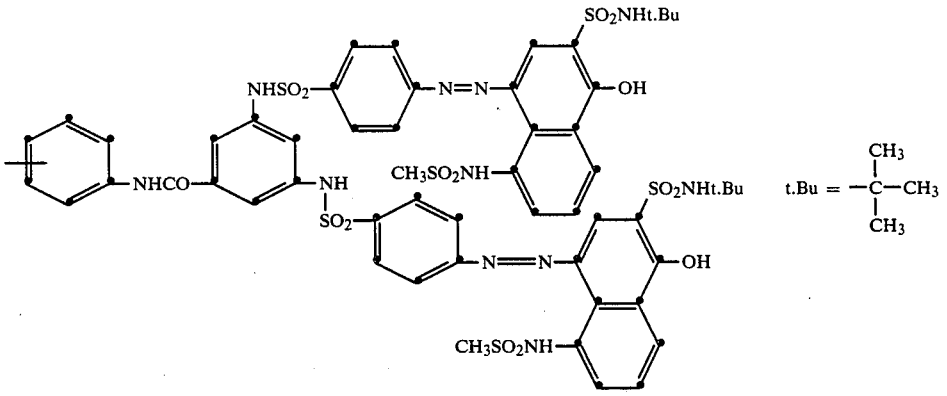
(8)
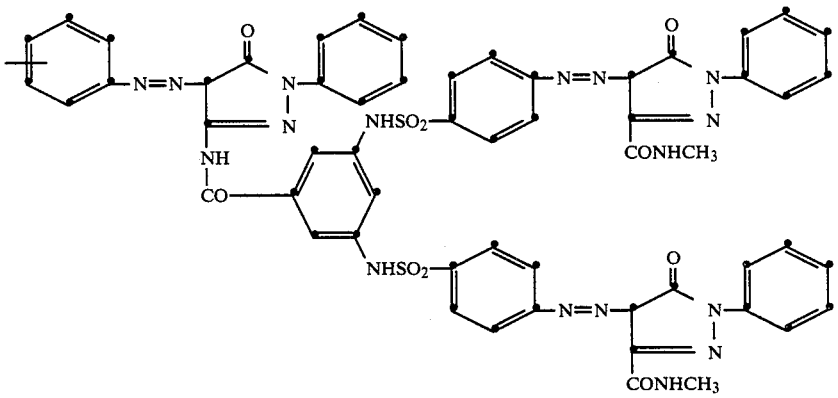
(9)
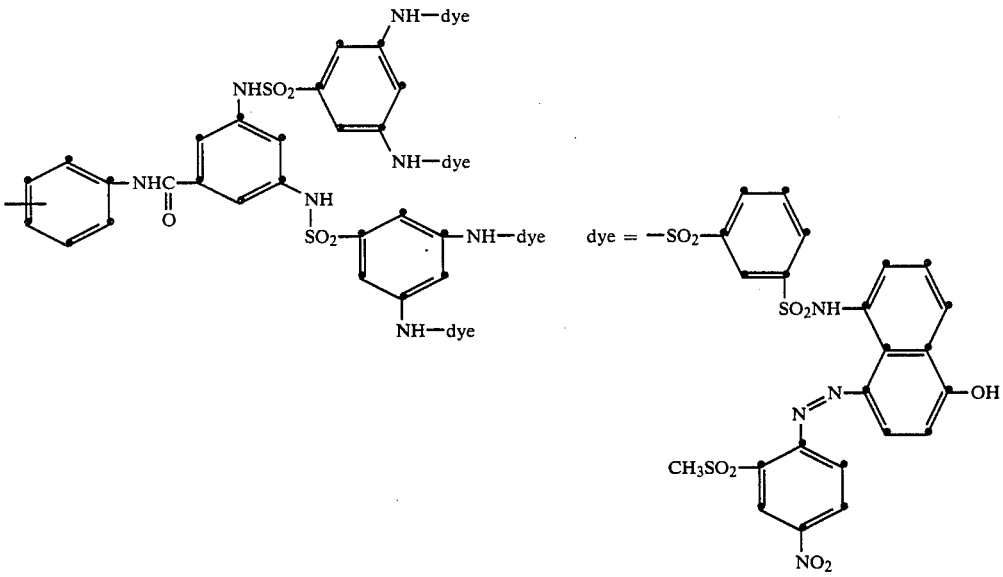

-continued
(10)
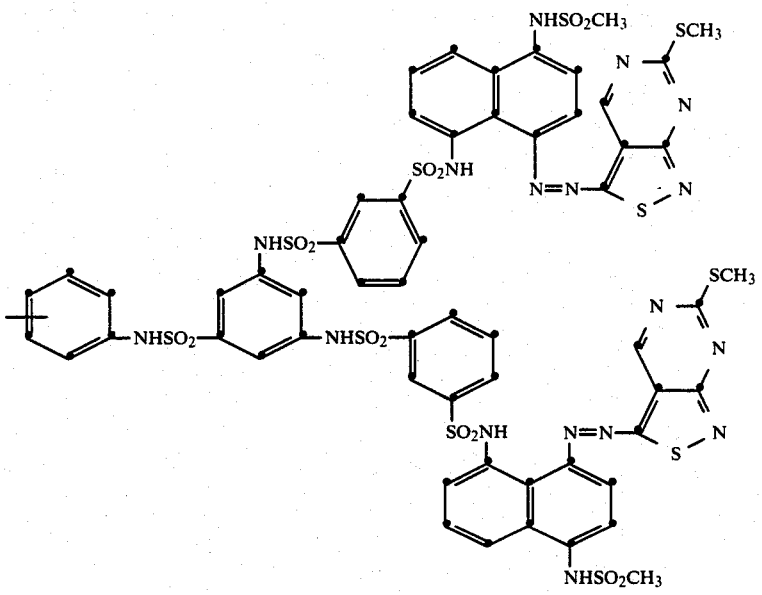
(11)
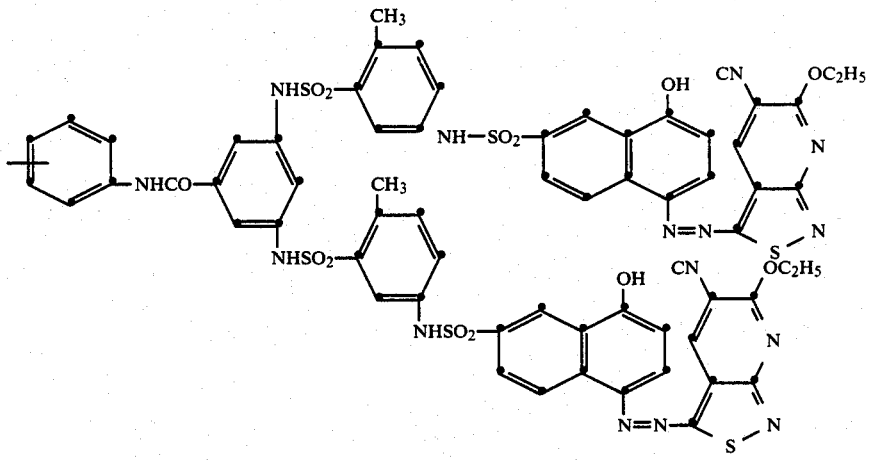
(12)
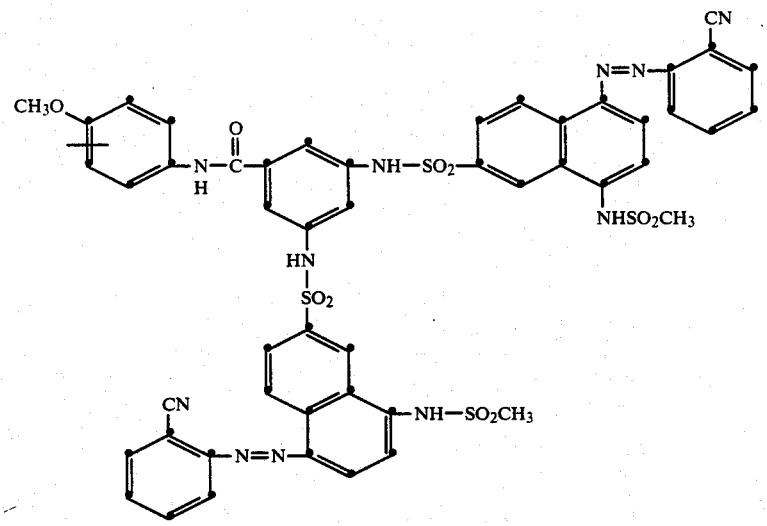

-continued
(13)
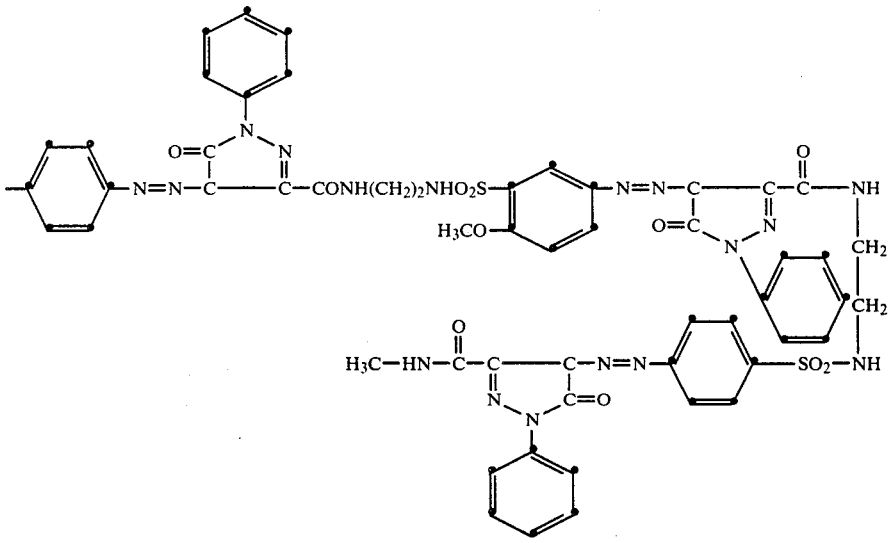
6. Photographic material according to claim 1, wherein CAR comprises a quinonoid nucleus.
7. Photographic material according to claim 1, wherein CAR—L— is a member selected from the group consisting of:
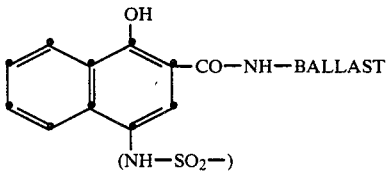
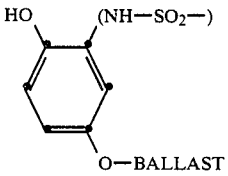
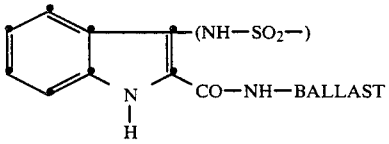
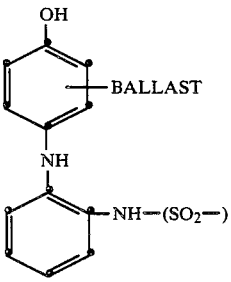
-continued
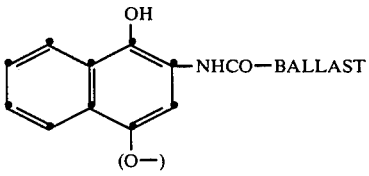
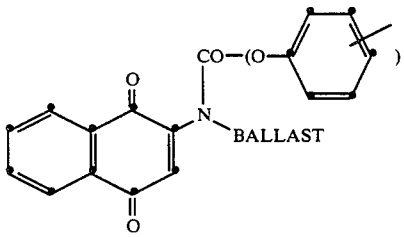
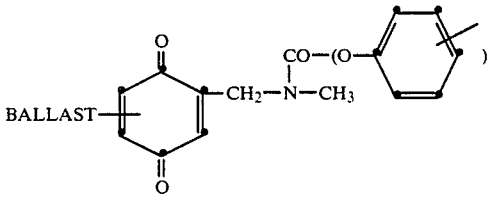
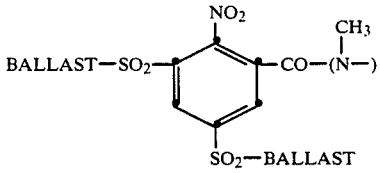
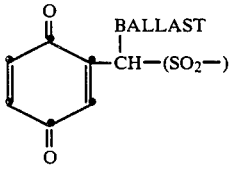

-continued

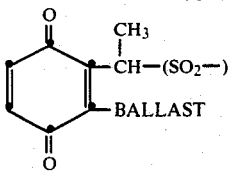

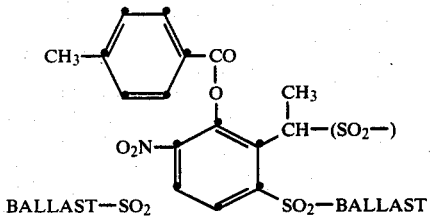

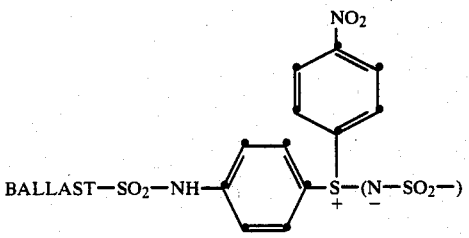

8. Photographic material according to claim 1, wherein the compound is a reducible quinonoid IHR-compound which after reduction can undergo a dye release with an intermolecular nucleophilic displacement reaction.

9. Photographic material according to claim 1, wherein the compound is a reducible quinonoid IHR-compound which can undergo a dye release by an elimination reaction.

10. Photographic material according to claim 1, wherein said material comprises a support carrying (1) a red-sensitive silver halide emulsion layer having operatively associated therewith a said dye-releasing compound that is initially immobile in an alkali-permeable colloid medium and wherefrom through the reducing action of a silver halide developing agent and alkalinity a cyan dye is split off in diffusible state, (2) a green-sensitive silver halide emulsion layer having operatively associated therewith a said compound of (1) with the difference that a magenta dye is split off in diffusible state, and (3) a blue-sensitive silver halide emulsion layer having operatively associated therewith a said compound of (1) with the difference that a yellow dye is split off in diffusible state.

11. Photographic material according to claim 1, wherein said material contains in each silver halide emulsion layer a non-diffusible electron donor compound or electron donor precursor compound.

12. Photographic material according to claim 1, wherein said material contains (a) silver halide emulsion layer(s) of the negative working type.

* * * * *